US005860232A

United States Patent [19]

Nathenson et al.

[11] Patent Number: 5,860,232

[45] Date of Patent: Jan. 19, 1999

[54] MOBILE SAFE EXCAVATION SYSTEM HAVING A DEFLECTOR PLATE AND VACUUM SOURCE

[75] Inventors: Richard D. Nathenson, Squirrel Hill; Jerome Apt, Jr., Pittsburgh; Paul M. Brumbaugh, Trafford, all of Pa.

[73] Assignee: Concept Engineering Group, Inc., Pittsburgh, Pa.

[21] Appl. No.: 761,665

[22] Filed: Dec. 6, 1996

Related U.S. Application Data

[60] Provisional application No. 60/008,291 Dec. 6, 1995.

[51] Int. Cl.[6] ..... E02F 03/00

[52] U.S. Cl. ..... 37/466; 37/905; 37/347; 15/300.1; 175/213; 175/67; 175/215; 175/424

[58] Field of Search ..... 37/466, 322, 323, 37/330, 331, 335, 344, 347, 320, 905; 15/405, 300.1; 175/67, 213, 215, 424; 171/16

[56] References Cited

U.S. PATENT DOCUMENTS

| | | | |
|---|---|---|---|
| 2,774,569 | 12/1956 | Jacobsen | 255/24 |
| 3,395,467 | 8/1968 | Allen et al. | 37/195 |
| 3,678,534 | 7/1972 | Hilbig | 15/345 |
| 3,916,634 | 11/1975 | Woodruff | 61/53.74 |
| 3,930,324 | 1/1976 | Wightman et al. | 37/189 |
| 3,968,845 | 7/1976 | Chaffin | 175/60 |
| 4,434,861 | 3/1984 | Howeth | 175/66 |
| 4,936,031 | 6/1990 | Briggs et al. | 37/80 |
| 4,995,175 | 2/1991 | Winter | 37/63 |
| 5,016,717 | 5/1991 | Simons et al. | 175/66 |
| 5,120,165 | 6/1992 | Walko, Jr. | 406/40 |
| 5,295,317 | 3/1994 | Perrott | 37/348 |
| 5,299,370 | 4/1994 | Gyori et al. | 37/347 |
| 5,361,855 | 11/1994 | Schuermann et al. | 175/67 |
| 5,408,766 | 4/1995 | Pobihushchy | 37/323 |
| 5,425,188 | 6/1995 | Rinker | 37/317 |
| 5,456,181 | 10/1995 | Theurer et al. | 15/300.1 |
| 5,487,229 | 1/1996 | Nathenson et al. | 37/347 |
| 5,535,836 | 7/1996 | Cagianut et al. | 175/213 |
| 5,555,941 | 9/1996 | Theurer et al. | 171/16 |

FOREIGN PATENT DOCUMENTS

| | | |
|---|---|---|
| 4138619 A | 11/1991 | Germany . |
| 58-222223 | 12/1983 | Japan . |

*Primary Examiner*—Michael J. Carone
*Assistant Examiner*—Victor Batson
*Attorney, Agent, or Firm*—Webb Ziesenheim Bruening Logsdon Orkin & Hanson, P. C.

[57] ABSTRACT

An integrated safe excavation apparatus utilizing supersonic air jets coupled with high flow, pneumatic vacuum transport and a unique separation system to excavate earth and other like material for the purpose of repairing, replacing or installing buried utility lines, remediating contaminated soils, uncovering buried objects containing discarded hazardous waste, safely exposing unexploded ordnance and other like operations.

46 Claims, 13 Drawing Sheets

MOBILE SAFE EXCAVATION SYSTEM HAVING A DEFLECTOR PLATE AND VACUUM SOURCE

CROSS REFERENCE TO RELATED APPLICATION

This application claims the benefit of U.S. Provisional Application Ser. No. 60/008,291, filed Dec. 6, 1995.

BACKGROUND OF THE INVENTION

1. Field of the Invention

This invention relates to a vacuum excavation system for safely dislodging and removing soil from around buried objects without damage using a combination of supersonic jets of air and pneumatic vacuum transport.

2. Description of the Prior Art

There is a significant need for an improved system that is capable of performing excavation in a safe and efficient manner for civilian, industrial, and military applications. Existing buried gas, electric, water, telephone and sewer utility lines are in constant need of repair and replacement. Though buried utility line detection technologies continually improve, lack of accurate location records and other practical problems lead each year to millions of dollars of expense and even explosions and loss of life due to excavation accidents involving underground lines. New service lines, such as cable television, must be added into areas with other existing utilities. New technologies such as ground-based, heat pump storage systems require large lengths of lines to be installed adjacent to existing homes and businesses. In the area of environmental remediation, drums, boxes and other containers of environmental waste buried in the past now need to be either removed or re-encapsulated due to leakage or more stringent standards. Finally, in the military sector there are millions of acres in the United States that contain buried unexploded ordnance that must now be removed to reclaim those acres for civilian purposes.

Several variations of vacuum excavation systems or vacuum assisted mechanical excavation systems are known in the prior art. U.S. Pat. No. 5,016,717 discloses an excavation system having a truck mounted suction tank connected to a vacuum blower. A hand-held wand with a liquid jet is provided to dislodge the soil and a hand-held flexible hose connected to the tank is provided to suck up the material.

German Patent No. DE 4138619-A describes a vehicle on wheels with a boom mounted cyclone type separator with a soil suction tube for excavating unmapped underground service lines. The soil suction tube hangs vertically from a flexible elbow and a rigid tube, which is in turn hydraulically raised and lowered. The suction tube has a curved inlet. A "Luftlanze" (air lance) alongside of the soil suction tube loosens the soil. The separator is round with a tangential material entrance and a bottom dump door.

Japanese Reference No. JP 58-222223 shows a rubber tired vehicle with a corrugated vacuum hose to suck up material from an excavation. The hose has several bends in it and includes a rigid end with a slight venturi on the open end. The hose disgorges its material into a primary box where the air travels through a permeable membrane and the material falls down to the bottom of the box under gravity and the reduced air velocity. The air travels into a second box where there are bag type filters. Slide gates are used to empty material from the boxes. Clean or filtered air that passes through the bags is drawn in by a rotary lobe type of blower which discharges into the atmosphere via a silencer. The blower is driven by an internal combustion engine.

U.S. Pat. No. 5,120,165 discloses a general pneumatic excavation system using a special multi-stage cyclone separator. This patent also discloses the use of a soil fragmenting device that includes mechanical, explosive and/or hydraulics.

U.S. Pat. No. 3,930,324 discloses a mobile, mechanical digging machine comprising a rotary cutting tool around a central suction tube. This digging machine is intended for small hole, utility type excavations for maintenance and repair. The rotary cutting tool is mounted to be moved in both horizontal and vertical directions and is deliberately powered sufficiently to be able to cut through macadam or asphalt. (Protection against cutting utility pipes is provided by an electromagnetic metal detector; hence, plastic pipe, i.e., modern gas pipe, is undetected.)

U.S. Pat. No. 3,968,845 discloses a truck mounted apparatus and method for complete reverse air geological drilling and coring. A conventional mechanical drill string is used to drill a vertical hole in the earth. Core material collection is accomplished by atmospheric air pulled first down through an annulus defined between the drill string and a bore hole wall and then passed up through the inside of the drill string at high velocity by an onboard vacuum pump. Conventional cyclones, hoppers and bags are used to separate the material from the airstream.

Finally, U.S. Pat. No. 4,434,861 discloses a method and apparatus for pneumatically conveying and collecting drill cuttings from a mechanical drill hole. This patent discloses an arrangement that surrounds the drill string and an arrangement for removing the material from the air via a combination of inertia, gravity, or filters.

Several patents disclose specific heads that use a combination of air and vacuum for general material dislodging purposes. For example, U.S. Pat. No. 4,936,031 describes a soft excavator using a rotary digging head with multiple supersonic air jets and a central vacuum. Compressed air is supplied to the rotating head via an annular chamber. The jets trace out an epitrochoidal pattern around the vacuum inlet. The head is mounted on a rigid vertical boom that is driven up and down via a rack and pinion gear arrangement. U.S. Pat. No. 4,995,175 discloses a pneumatic excavation head for underwater debris. Compressed air is introduced down an annulus and out through multiple openings into the sand and gravel bottom to loosen and lift it into a central pipe. U.S. Pat. No. 3,916,634 describes a method to form vertical holes in the earth using air of at least seventy-five psig released uniformly from an annulus to loosen and lift material into a central pipe. U.S. Pat. No. 3,395,467 discloses a head for harvesting peat moss that uses a first airstream to loosen a top strata of dryer, milled material from a bottom strata of damper material and a second airstream to entrain and transport the loosened dryer material. U.S. Pat. No. 3,678,534 describes a vacuum cleaner head with a suction tube and multiple small diameter orifices fed by gas at a pressure on the order of forty psig, such that gas jets exit these orifices at supersonic speed and impinge on a surface to be cleaned.

Commercially available vacuum excavation units today have common features and common problems with soil dislodging and transport. Aside from the mechanical diggers mentioned above, which are certainly not non-damaging to buried objects, the units use a fluid under pressure released from a hand-held lance to dislodge the soil. Some units use water released under moderate pressure. Water has a number of disadvantages including: making mud which is difficult and disagreeable to handle; adding weight and volume to the waste stream which needs to be disposed of; freezing in the excavation in the winter; and needing to be carried onboard the unit taking up significant space and adding weight that must be transported. Most units use air as the working fluid released simply through the open end of a pipe nipple with air flows from seventy-five to one hundred and eighty-five standard cubic feet per minute (scfm) at generally one hundred pounds per square inch gauge (psig). Although an air lance, including a valve and a pipe is rugged and cheap to make, it results in an inefficient compressed air digging tool. Compressed air exiting from the open end of a pipe nipple in an air lance expands suddenly to atmosphere in a broadened manner with a loss of focus of kinetic energy and momentum. For example, considering a standard portable air compressor of one hundred seventy-five scfm at one hundred psig, the wasted fuel costs for an air lance over a properly designed supersonic air jet is about fifty dollars for every one hundred hours of use. Viewed another way, to do a given amount of work, the size of the compressor needed is also larger than necessary due to the inefficiency of an air lance.

All of the current commercial vacuum excavation units use simply a vacuum hose to convey the material from the excavation to the hopper. Two types of hoses are commonly used: an inexpensive corrugated lightweight underground drainage type plastic hose, or a heavy wall rubber vacuum hose. The lightweight, inexpensive hose can be slung over a laborer's shoulder and is very flexible. However, this flexibility typically causes many severe bends in the hose. These bends lead to serious clogging problems and high suction losses. The frequent clogs are cleared either by wrapping the hose with a mallet or replacing the entire hose, both of which take time away from the digging. The other heavy rubber hose is too expensive to be discarded. Descended from sewer sucker types of trucks, typically the heavier hoses are used along with water jets. The water provides lubrication to allow the material to slide along the inside of the hose. Because of their high weight, this type of hose is supported from a fixed boom which is raised or lowered hydraulically, but moved by hand from side-to-side which can be difficult and fatiguing.

Typically, all of the vacuum excavation units also suck the soil into a hopper or tank. Tank sizes vary with about 70% of the units having a volume less than about forty cubic feet. In all cases, the tank size limits the amount of work that can be done before the process has to be interrupted. The larger the tank, the more space is taken up on the unit and the greater the cost of the tank since it must be designed to take the full vacuum capacity of the system. When the vacuum excavator tank is mounted on the truck and the spoil cannot be put back in the hole by local regulation, the truck itself needs to leave the work site when its tank is full.

Therefore, it is an object of the present invention to provide for an excavation system that overcomes the problems of the prior art.

SUMMARY OF THE INVENTION

The present invention incorporates multiple, rotating supersonic air jets, high flow, pneumatic vacuum transport and a separating system to dislodge soil or other porous material and to convey the dislodged material away from the excavation. The apparatus allows excavation without danger of harm or disruption to sensitive buried objects due to the non-contacting nature of the air jets and pneumatic suction head.

The excavation system has many distinctions and advantages over the prior art. Unlike conventional vacuum excavation systems that use an air lance, i.e., compressed air exiting a pipe nipple, the apparatus disclosed here uses a multiplicity of miniature supersonic air jet nozzles. Each nozzle properly accelerates compressed air into a focused stream of supersonic air. This stream delivers the energy and momentum to a distinct area of the soil. The supersonic air jet, hence, has a superior ability to dislodge harder and more cohesive soils containing a higher percentage of clay than does the airstream from an open pipe nipple. In addition, an air lance uses considerably more air than a supersonic air jet per unit of time in doing an equivalent amount of work. Thus, the required size of support air compression equipment and the amount of energy used to compress the air is reduced when using supersonic air jets.

The supersonic air jets are mounted into an integrated digging head. The head contains an arrangement to move the jets about an axis for dislodging. The head also contains a vacuum suction inlet. The integration of both the dislodging arrangement and the removal arrangement into a single head creates a synergistic effect. The vacuum constantly removes dislodged material positioned forwardly of the jets so the jets can dislodge new material while the jets aerate and initially make the material airborne into the vacuum airstream. The high flow vacuum and design of the excavating head, additionally, keeps the working area free of dust emissions, especially significant when working with hazardous waste. The single head permits one man to operate the system, rather than one man each for the air tool and the vacuum hose as in conventional systems. The motion of the jets about the axis of the head in addition to the motion of the head increases the ease of use and the amount of material that can be dislodged by each jet in a given amount of time. Since soil is generally not a free flowing material, especially when damp, this system utilizes a material transport system that minimizes clogging. Conventional systems which use standard vacuum hoses are highly prone to persistent clogging due to the generally rough inner wall and to the many bends inherent when using a hose for a suction and transport tube. The present invention utilizes a material transport arrangement that is smooth, lightweight and free of bends. The integrated digging head and material transport arrangement are also easily adapted for entirely remote operation which is especially important when the excavated material contains either chemical or radioactive waste. While all other conventional vacuum excavation systems suck the material into a hopper of a fixed size and must stop once it is full, this system is flow through, continually discharging the excavated material. Excavated soil may be directly fed into drums or other containers for transport offsite. Since many industrial or military sites are on open terrain, the present invention is capable of off-road travel and operation. Most conventional vacuum systems operate only on pavement or need extensively long hoses to operate well off a road.

More particularly, the present invention is an excavator that includes an excavator head having an inlet port and an outlet port, a conduit fluidly coupled to the inlet port and a separator fluidly coupled to the conduit. The outlet port is adapted to exit high speed air toward a target to dislodge material therefrom. The inlet port is adapted to suck the dislodged material via a vacuum source. The separator includes a body defining a plenum chamber having a deflector plate spaced from an exit end of the conduit and adapted to deflect the sucked dislodged material. The separator defines an exit port through which the dislodged material can pass, wherein the exit port is separate from the inlet port. The separator can include a primary separator and secondary separator and rotating vanes can be provided within the plenum chamber for directing the dislodged material toward the exit port. A rotary valve can be provided which is in fluid communication with the separator.

The present invention is also directed to an excavator head that includes a stationary member, a rotating member rotatably coupled to the stationary member, a nozzle for directing a stream of air toward a target secured to the rotating member, a compressed air inlet defined in the stationary member, and a conduit passing through the stationary member and the rotating member. The conduit includes a conduit inlet which is radially spaced from the nozzle. An annular region is defined by the conduit and the stationary member, which is coaxial with the conduit. The compressed air inlet is fluidly coupled to the annular region, which is fluidly coupled to the nozzle. A flow blocking member is provided and contained within the annular region and secured to the rotating member. The flow blocking member is adapted to periodically block fluid communication between the annular region and the nozzle to periodically prevent a flow of compressed air to the nozzle. This arrangement results in a pulsing of air passing through the nozzle.

The present invention is also a separator for use with a section conduit used in an excavator that includes a body that defines a plenum chamber, an inlet port adapted to be fluidly coupled to a suction conduit, an outlet port adapted to be fluidly coupled to a vacuum source, and the suction conduit adapted to transport dislodged material to the plenum chamber. The body defines an exit port for dislodged material to pass. A vane is rotatably secured to the body and contained within the plenum chamber for directing the dislodged material towards the exit port. A vacuum lock is provided and fluidly coupled to the exit port which is adapted to permit the dislodged material to pass.

The present invention is also a method for excavating material that includes the steps of: directing an airstream toward a target material; dislodging the target material by the airstream; sucking the dislodged material and air into a plenum chamber; contacting the dislodged material with a deflector to cause the dislodged material to remain in a plenum chamber while permitting sucked air to pass through the plenum chamber; and directing remaining dislodged material in the plenum chamber to an exit port via a rotating vane.

Additional objects, features and advantages of the invention will become apparent to those skilled in the art from the following detailed description and attached drawings on which, by way of example, only the preferred embodiment of the invention is illustrated.

BRIEF DESCRIPTION OF THE DRAWINGS

.

DESCRIPTION OF THE PREFERRED EMBODIMENTS

Figure 1:
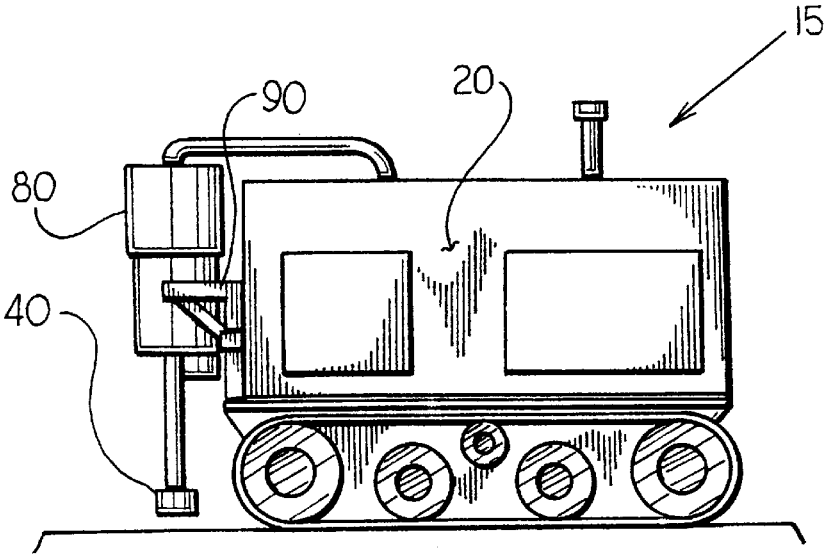
FIG. 1 is an elevational view of the vacuum excavation system including an excavation head, a material separator and an equipment package made in accordance with the present invention.

FIG. 1 of the drawings shows an overall view of a vacuum excavation system or excavator 15 having an equipment package 20, an excavation head or excavator head 40 and a material separator assembly 80. The equipment package 20 contains the prime mover 21 and physically supports the remainder of the system. The equipment package 20 also contains an arrangement to compress air to be fed to the supersonic nozzles, to create a flow of air at a pressure below atmospheric, and to reject the heat created by the prime mover 21 and air handling processes. Although it is preferable to use supersonic nozzles with the present invention, subsonic nozzles can also be used. The equipment package 20 also includes a base which is preferably self mobile. The excavation head 40 contains primarily a plurality of supersonic air jet nozzles and a vacuum inlet. The material separator assembly 80 includes an arrangement to receive excavated material from the excavation head 40, isolate the excavated material from an airstream so as to separately discharge the excavated material and to clean and separately discharge the air. The material separator assembly 80 also includes a material transport boom, primary and secondary separator sections, a rotary valve, filters and supports by which the assembly is attached to the equipment package 20.

Figure 2A:
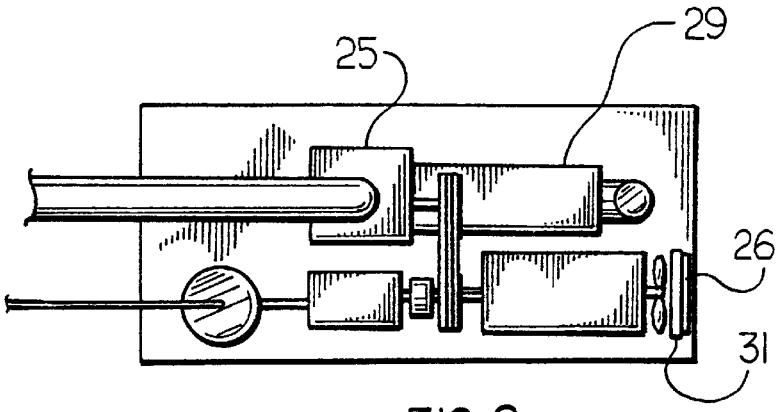
FIG. 2A is a top plan view of a portion of the equipment vacuum excavation system shown in FIG. 1 showing a prime mover, a compressed air and vacuum air generation device and ancillary support equipment.
Figure 2B:
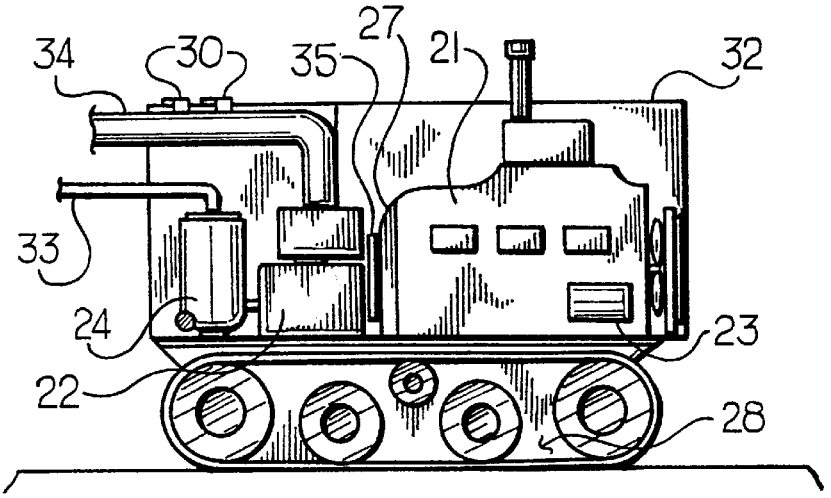
FIG. 2B is a side elevational view of the portion of the equipment shown in FIG. 2A.

FIGS. 2A and 2B of the drawings show the equipment package 20 in more detail which includes a prime mover 21 that is preferably an internal combustion engine for ease of use in a mobile application. Depending on total power, customer preference, and/or air quality requirements, the fuel may be diesel, gasoline, propane, or liquefied natural gas. A radiator and fan 31 is provided to dissipate the heat of combustion of the engine or prime mover 21. Although not specifically shown, the engine or prime mover 21 includes standard ancillary equipment, such as a battery, an alternator, a fuel tank, gauges, an exhaust muffler and controls which are well known in the art. A clutch 27 is mounted onto a flywheel provided on an end of the engine. Alternatively, the clutch 27 need not be present. Alternatively, if the vacuum excavation system 15 is to be used in an indoor environment where combustion products are not desired, then the prime mover 21 could be an electric motor with an appropriate motor starter. The prime mover 21 provides the drive torque to all other items on the equipment package 20, specifically to an air compressor 22 and a vacuum pump 25.

The air compressor 22 is preferably an oil flooded, rotary screw type air compressor which is directly coupled to the prime mover 21 through a flexible coupling 35 to allow for misalignment and vibration. Typically, the air compressor is capable of producing a desired volume of air at a pressure of generally within the range of one hundred to two hundred psig (pounds per square inch gauge). Depending on the desired digging rate of the overall unit, the air flow will be preferably within the range of one hundred to six hundred scfm. As described in the co-pending patent application entitled "Contoured Supersonic Nozzle", filed Jun. 24, 1996, bearing Ser. No. 08/669,212, which is hereby incorporated by reference, a supersonic nozzle operating on compressed air at about one hundred psig will produce a jet traveling at approximately twice the speed of sound, i.e., Mach 2. An air receiver 24 and ASME coded pressure vessel are fluidly coupled with the air compressor 22 and are used as a storage tank and an air/oil separator. An oil radiator 26 is included with the air compressor 22 to eliminate the heat due to compression. The oil radiator 26 may be installed in series with the radiator for the engine or prime mover 21, as shown, or it may be a separately mounted unit and provided with a separately driven fan.

To produce the flow of air at a pressure below atmospheric pressure to transport material through the system, a vacuum pump 25 is required. Generally of a positive displacement, rotary lobe configuration, the vacuum pump 25 may be driven by multiple belts from a pulley on a drive coupling on the prime mover 21. The vacuum pump 25 needs to provide sufficient suction to accelerate and lift material from the excavation head into the separator and to overcome air friction and head losses in the system. The positive displacement type of a vacuum blower is preferred over a centrifugal fan since the flow stays approximately constant with increased head rather than reducing. Typical operating levels are low at from three to six inches of Hg vacuum as opposed to industrial vacuums which may require up to eighteen inches of Hg. Air flows vary considerably depending on the desired excavation rate. Preferably, values of from 1,000 to 4,000 scfm (standard cubic feet per minute) can be used. Vacuum relief valves 30 are fluidly coupled to the vacuum pump 25 typically used to ensure flow to the vacuum pump 25 in case the primary material transport tube would be accidentally completely blocked. A conventional absorptive, multi-chamber silencer 29 is provided on the discharge of the vacuum pump 25 to lower the exit noise.

The engine or prime mover 21, air compressor 22, vacuum pump 25, air receiver 24, multi-chamber silencer 29, radiators and other support equipment are mounted on a mobile base 28. For offroad service, the mobile base 28 is preferably a conventional, tracked chassis. The tracks are preferably rubber to avoid damage when traveling on lawns or asphalt. The tracks provide a very low ground pressure which is very advantageous when dealing with unexploded ordnance. The tracks may be hydraulically driven through motors and torque hubs in a manner well known in the art in which hydraulic power is provided by an engine driven pump 23.

The equipment package 20 is enclosed by a skin 32 composed of sheet metal panels. Preferably, sound isolation material is installed on an interior surface of the skin 32 to reduce the overall noise level of the equipment to acceptable levels. Doors (not shown) are provided in the skin 32 for access to the internal equipment for service. Compressed air from the air receiver tank 24 to the excavating head is delivered via air pipe and/or hose 33. Vacuum air flow comes from a separator package into a vacuum blower via pipe and/or hose 33.

Figure 3A:
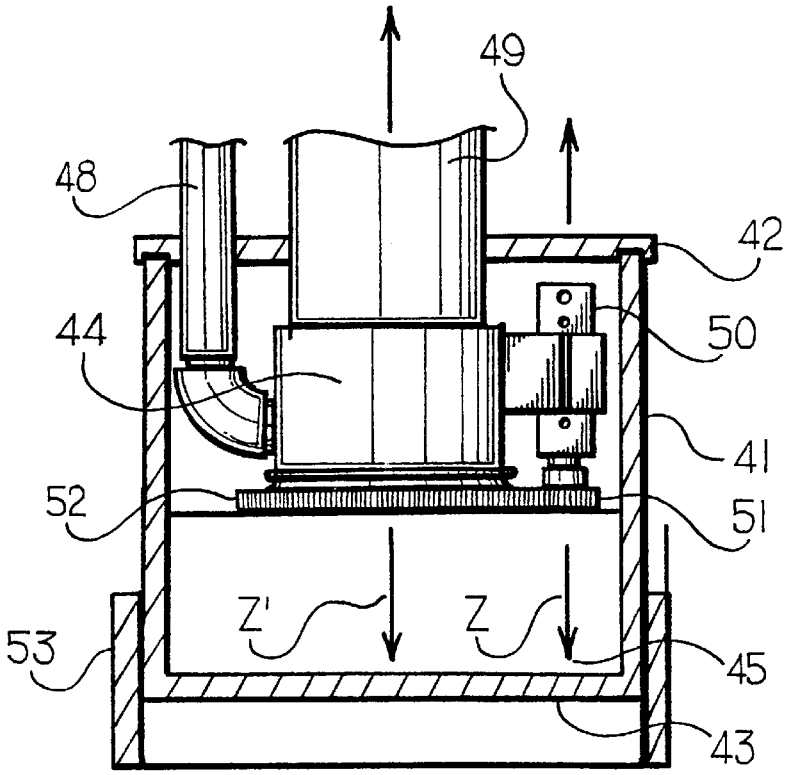
FIG. 3A is an elevational view, partially in section, of a portion of the excavation head shown in FIG. 1.

FIG. 3A of the drawings shows an external and cut-away view of the excavation head 40. A cylindrical shell 41 forms an exterior portion of the excavation head 40. The shell 41 is made of a non-metallic material such as glass epoxy tubing for strength as well as non-conductivity and non-sparking. A circular top cover 42 and a circular bottom cover 43 are secured to opposite ends of the shell 41 and are similarly composed of a non-metallic material. This non-metallic material is an ultra high molecular weight (UHMW) polyethylene plastic for superior wear resistance in material handling applications. Compressed air is fed to the excavation head 40 via an air hose 48 which is composed of standard, flexible, braid reinforced synthetic rubber materials. The cylindrical shell 41, the top cover 42 and the bottom cover 43 define an internal portion of the excavation head 40 that contains a stationary member 44 and a rotating member 45. The rotating member 45 is rotatably coupled to the stationary member 44. The stationary member 44 is preferably made from steel, while rotating member 45 is made from steel or, to save weight, aluminum. The stationary member 44 connects directly to a lower vacuum tube 49. The relative rotation between the stationary member 44 and the rotating member 45 may be accomplished in any one of a number of ways. Preferably, this is accomplished by an air motor 50 that drives a pinion gear 51. The air motor 50 is attached to the stationary member 44, and a pinion gear 51 is rotatably secured to the air motor 50.

An annular driven gear 52 is rotatably attached to the rotating member 45. Compressed air from the air hose 48 delivered to the air motor 50 causes the pinion gear 51 to rotate about a longitudinal axis Z and against the driven gear 52 and, hence, to cause the rotating member 45 to rotate about a longitudinal axis Z' relative to the stationary member 44. A standard filter, lubricator and regulator (not shown) are used to provide oil for and to control the pressure and, hence, speed of the air motor 50. The shell 41 and the bottom cover 43 are rigidly secured to rotating member 45 so that they too rotate about the axis Z' along with rotating member 45. The top cover 42 rests on the shell 41 so that the lower vacuum tube 49 and the top remain stationary with the stationary member 44. The lower vacuum tube 49 passes through the stationary member 44. The bottom cover 43 defines a single central opening 67 which forms the inlet to a vacuum system and multiple openings 46 through which the supersonic jets coact. A skirt 53 surrounds a lower portion of the shell 41 and extends on the order of one to two inches below the bottom cover 43. The skirt 53 is made of a flexible material such as fiber-reinforced rubber belting. Other arrangements for rotating the head could be used, including belts instead of gears and/or hydraulic or electric motor instead of an air motor.

Figure 4:
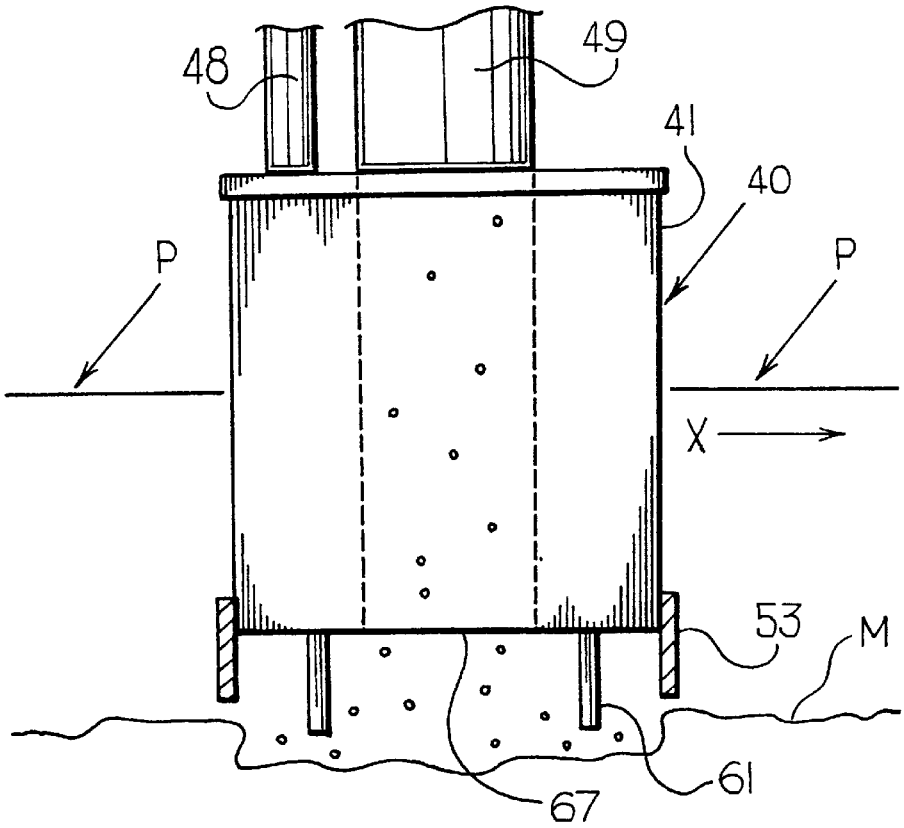
FIG. 4 is an elevational view, partially in section, of the excavation head in operation next to a soil surface.
Figure 5:
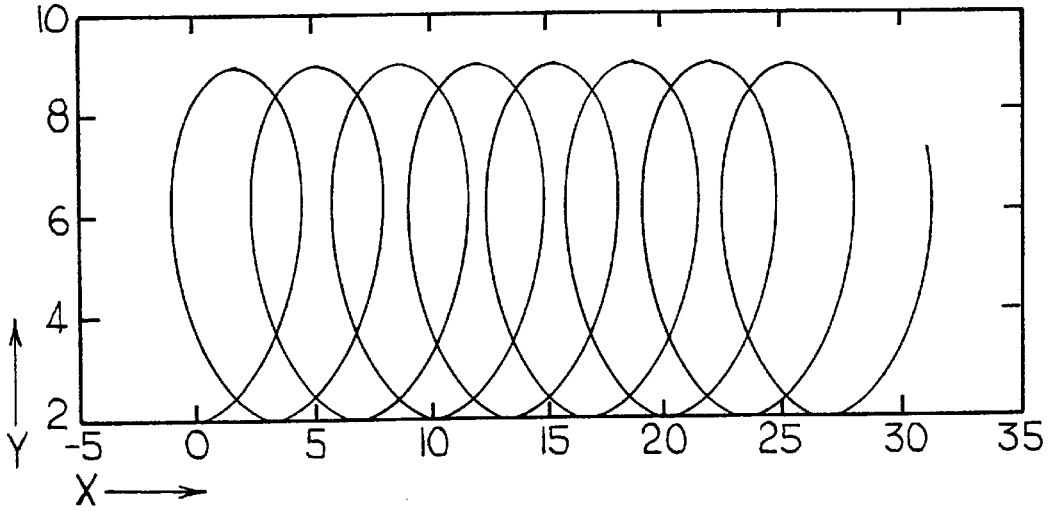
FIG. 5 is a graph representing a pattern that an air jet exiting the excavation head shown in FIG. 4 traces on the surface of the soil.

As shown in FIG. 4 of the drawings, in operation the excavation head 40 is moved in close proximity but above the surface of the material M to be excavated. The compressed air is discharged at the excavation head 40 through the multiple holes in the bottom cover 43 in highly focused jets (of air) 61 moving greater than the speed of sound through nozzles 60. These jets efficiently dislodge the soil but will not damage or disturb buried objects, such as utility pipes, waste containers or unexploded ordnance. Atmospheric air drawn by the positive displacement vacuum pump 25 picks up the material dislodged by the air jets and carries it into the central opening or inlet port 67 in the excavation head 40 by sucking the dislodged material via a vacuum source into the lower vacuum tubes 49. The skirt 53 on the excavation head 40 acts as a dust and dirt seal keeping loosened material under the head as it excavates. Using the integrated excavation head 40, digging rates superior to the generally achievable one to two cubic feet per minute of conventional vacuum excavation equipment can be achieved. As the excavation head 40 is moved along the surface of soil or material M to be excavated due to its rotation an intersecting pattern of an air jet on the ground is traced, as shown in FIG. 5 of the drawings. By proper choice of the translational and rotational speeds of the head, a full coverage pattern can be achieved. For example, if the rotational speed of the head is approximately sixty revolutions per minute and the translational speed of the head in an X direction is sixty feet per minute, for a head diameter on the order of one foot, a good cutting pattern can be achieved with one or two jets exiting from the head, each at a different radius r from the center of rotation of the excavation head 40. With these parameters, each jet and, in turn, each nozzle 60 traces out a curtate, i.e., looped, trochoid.

Figure 3B:
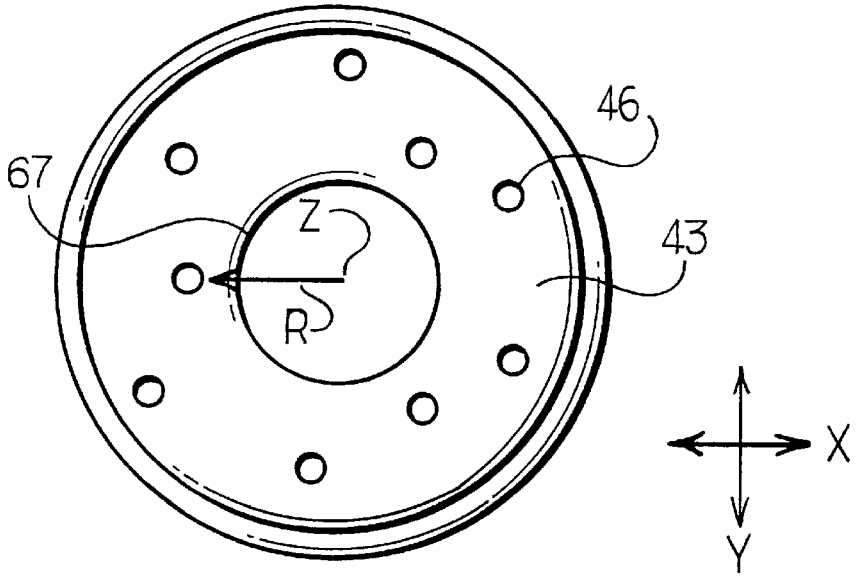
FIG. 3B is a bottom plan view of the excavation head shown in FIG. 3A.
Figure 6A:
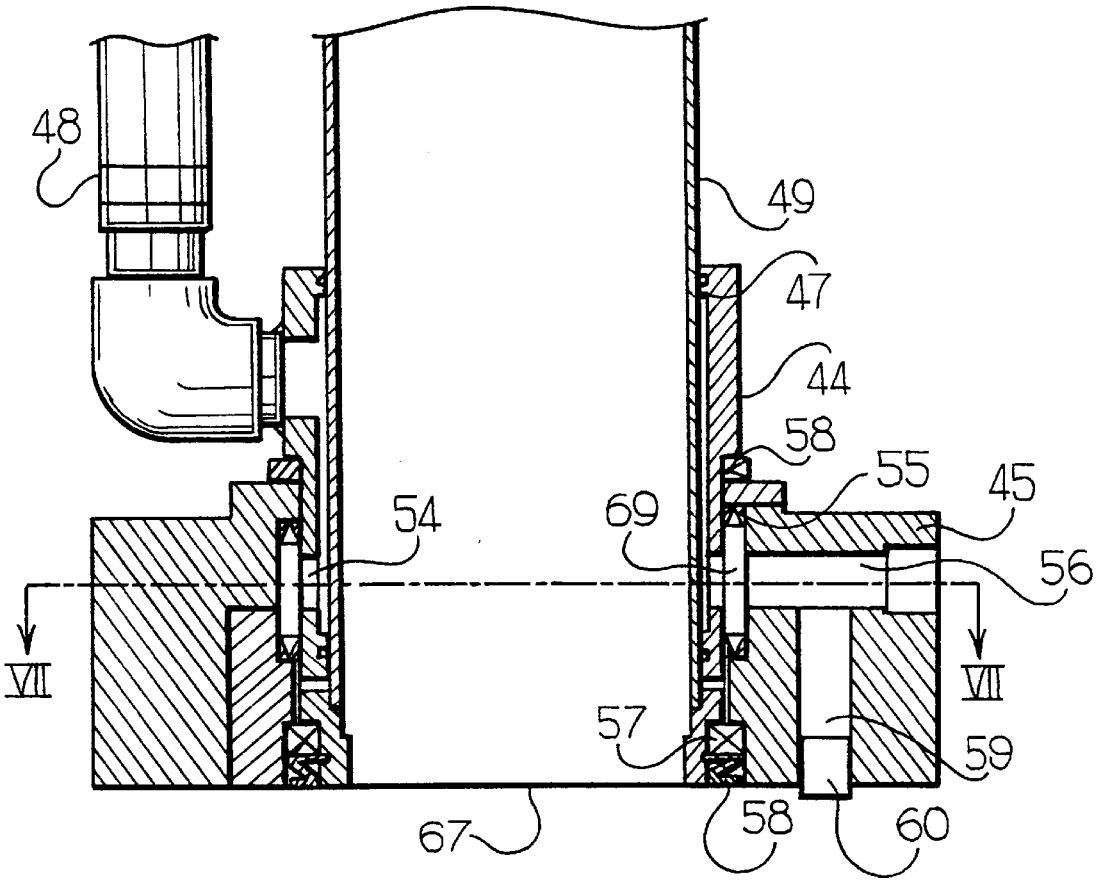
FIG. 6A is an elevational cross-sectional view of a portion of the excavating head (without a skirt) shown in FIG. 4.
Figure 6B:
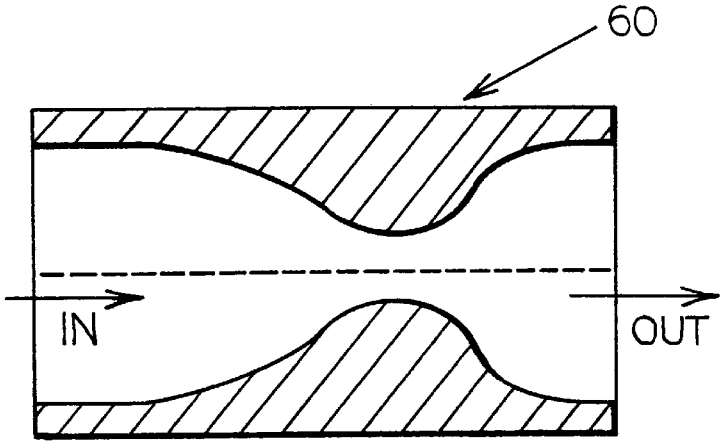
FIG. 6B is a sectional view of a converging-diverging supersonic nozzle.

FIG. 6A of the drawings shows an elevational cross-sectional view of the details of the interior of the excavating head 40. To transfer the compressed air from the stationary member 44 to the rotating member 45, a chamber 69 is used. Compressed air travels from the air pump hose 33 to the excavation head 40 through air hose 48. The air introduced into an air inlet I defined in the stationary member 44 which is fluidly coupled to an annulus or annular region 47 created between lower vacuum tube 49 and stationary member 44. The annulus 47 is coaxial with the lower vacuum tube 49. A plurality of holes 54, in the present embodiment three, in stationary member 44 direct the compressed air from the annulus 47 into the chamber 69. A U-cup or cartridge type rotary seals 55 made from a low friction material, such as graphite filled Teflon®, prevent the compressed air from exiting at the top and bottom inner surface of the chamber 69 in the gap needed between stationary member 44 and rotating member 45. As can be seen, no matter what the angular position of the rotating member 45 is relative to the stationary member 44, compressed air is always supplied to multiple horizontal, radial passages or passageways 56 which are machined in the rotating member 45. Passages 56 are fluidly coupled to the annulus 47. A bearing 57 positions and supports the rotating member 45 relative to the stationary member 44. V-ring type dust seals 58 are used above and below the rotating member to keep contamination away from the moving parts. Into each radial passage 56, a vertical or angled passage 59 is drilled through rotating member 45. At the exit of each angled passage 59 defined in the rotating member 45, a supersonic air nozzle 60 is installed defining an outlet port which is adapted to exit high speed air toward a target, i.e., soil or other material to dislodge the material. Details of the construction of a supersonic air nozzle 60 are disclosed in U.S. Patent Application entitled "Contoured Supersonic Nozzle", filed Jun. 24, 1996, bearing Ser. No. 08/669,212 which is hereby incorporated by reference. FIG. 6B shows a cross section of a cylindrical body having a converging-diverging supersonic nozzle defined therein which can be designed by one skilled in the art. U.S. Pat. No. 4,936,031 also discloses details for a supersonic nozzle. In general, each nozzle 60 includes a contoured converging-diverging passage that expands and accelerates air at a pressure of from about one hundred to two hundred psig and a very low velocity in the angled passage 59 to atmospheric pressure and a velocity on the order of two to two and one-half times the speed of sound at the exit of the nozzle 60. The exit to each supersonic air nozzle 60 is aligned with one of the openings 46 in the bottom cover 43 as shown in FIG. 3 of the drawings so that the air jets 61 travel below the excavation head 40, as shown in FIG. 4 of the drawings. Although it is preferable to have supersonic nozzles, subsonic nozzles can be used.

Figure 7:
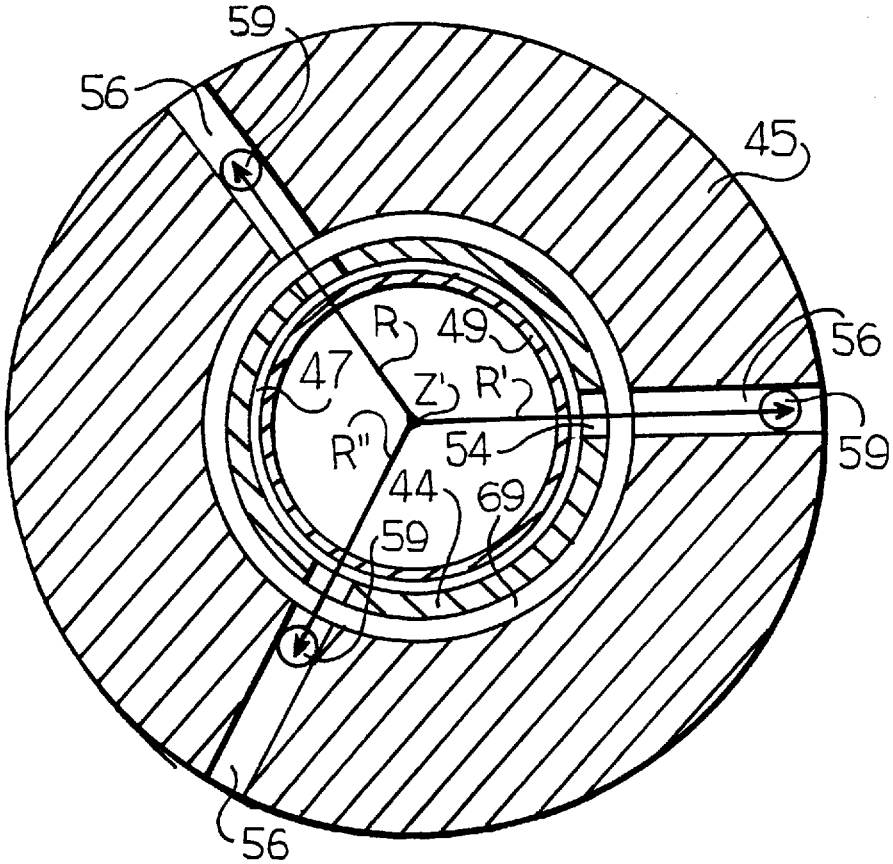
FIG. 7 is a section taken along line VII—VII of FIG. 6A.

FIG. 7 of the drawings shows the three circumferential locations of the multiple radial passages 56 and vertically oriented passages 59 in the current embodiment. Depending on the desired digging rate and the amount of supplied compressed air, the number of such passages (56 and 59) may vary. Preferably, the vertical passages 59 are located at different radii r, r' and r" that extend from the axis Z' (although they can be located at the same radius) so that nozzles 60 are radially spaced at different radii from the central opening 67 as well as circumferentially spaced about the central opening 67. In this manner, each jet traces out a different curtate trochoid as the excavation head 40 rotates about the axis Z' and translates improving the excavation operation. The skirt 53 extends below nozzles 60 and the central opening 67.

Figure 8A:
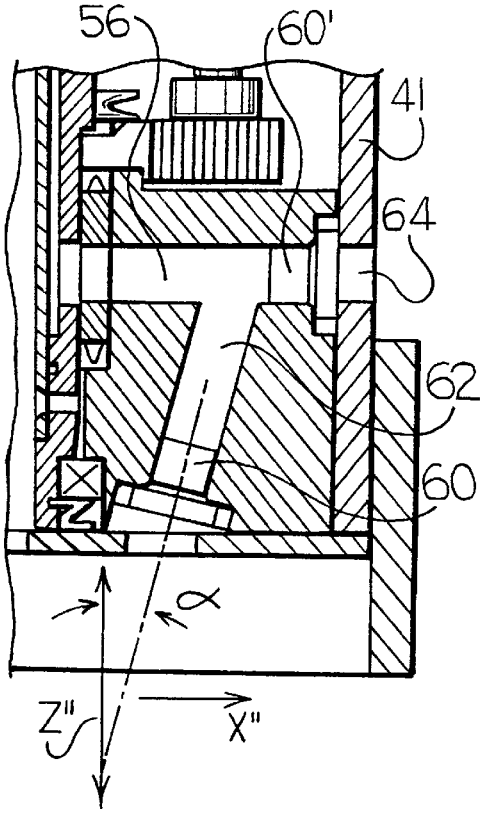
FIG. 8A is an elevational view, partially in section, of a portion of a second embodiment of an excavation head with an angled nozzle orientation made in accordance with the present invention.
Figure 8B:
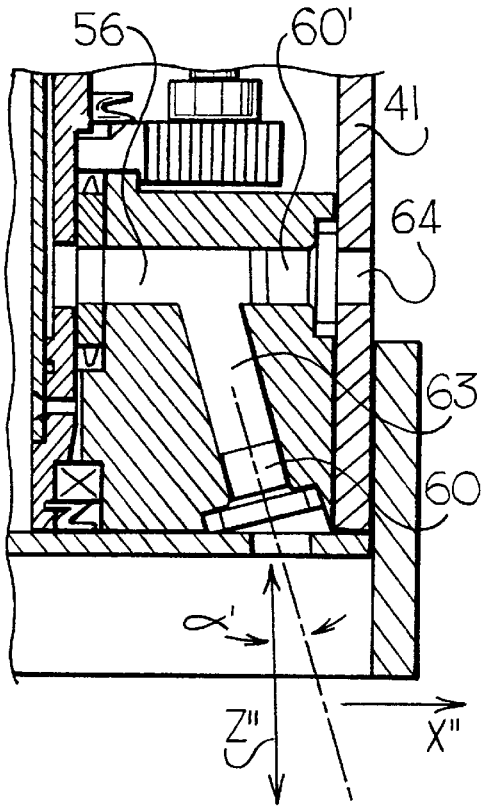
FIG. 8B is an elevational view, partially in section, of a portion of a third embodiment of an excavation head with an angled nozzle orientation made in accordance with the present invention.

FIGS. 8A and 8B of the drawings show alternate orientations of angled passage 59 as opposed to a straight passage 59, as shown in FIG. 6A of the drawings. Passages 62 and 63, as shown in FIGS. 8A and 8B of the drawings, respectively, are inclined at an angle $\alpha$ and $\alpha'$ to a vertical axis Z" or the axis of rotation Z'. In this manner, the air jet exiting from a supersonic air nozzle 60 installed in either of these passages has the additional ability to reach toward the center or toward the outer edge of the excavation head 40. This gives the excavation head 40 the additional capability of vertically boring into the earth or material M with or without the need to move in a horizontal motion X". FIGS.

8A and 8B of the drawings also show an alternate position for a nozzle 60 at an outer diameter of the excavation head 40 in the passage 56. Hence, a nozzle 60' coupled with a hole 64 formed in the shell 41 provides a capability to cut dislodged material on a side of a bore hole.

Figure 9A:
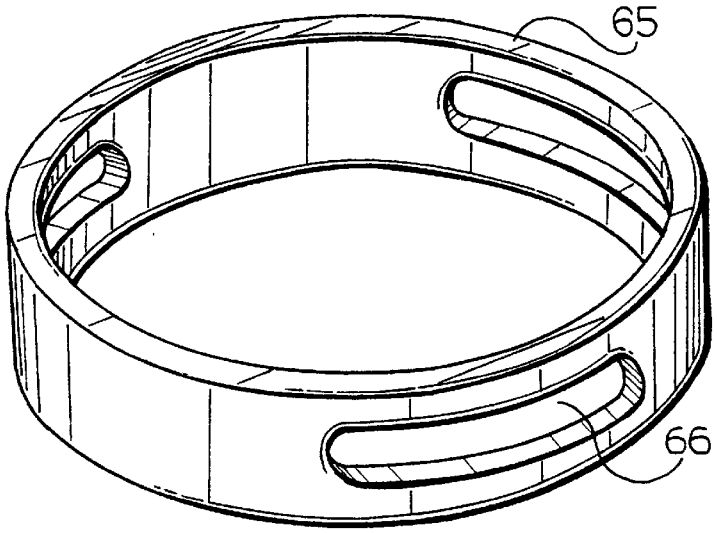
FIG. 9A is a top perspective view of a valve plate or slotted ring.
Figure 9B:
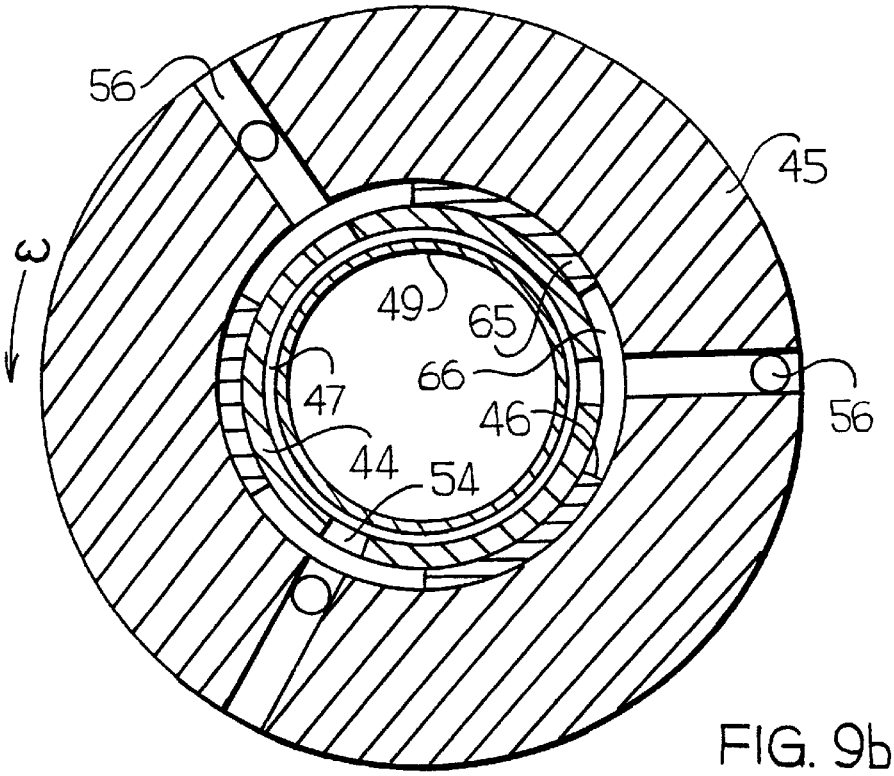
FIG. 9B is a sectional view of the valve plate shown in FIG. 9A positioned in an excavating head, wherein the valve plate is in a first position.
Figure 9C:
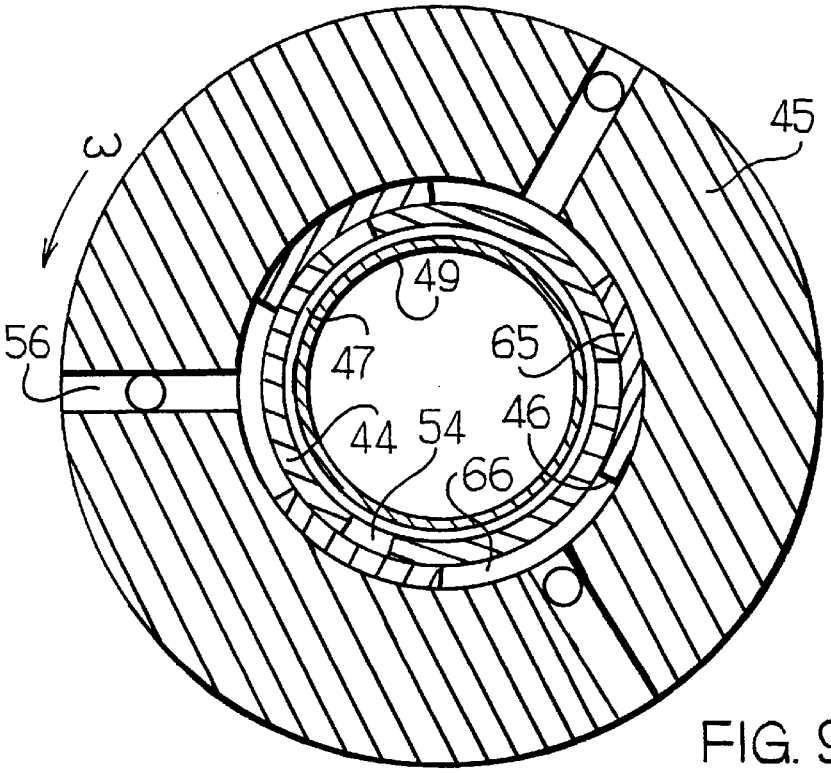
FIG. 9C is a sectional view of the valve plate shown in FIGS. 9A and 9B positioned in an excavating head, wherein the valve plate is in a second position.

FIG. 9A of the drawings shows a slotted ring or flow blocking member 65 which can be added into the annulus 47 and connected, for example, via bolts to rotating member 45. This ring, which defines a plurality of slots 66, causes pulsing of each of the air jets 61 shown in FIG. 4 of the drawings, rather than in a continuous manner by periodically blocking the annulus 47 and the radial passages 56 which periodically prevents the flow of compressed air to the nozzles 60 thereby resulting in the pulsing of air passing through the nozzles 60. As shown in FIG. 9B of the drawings, when a slot 66 of the ring is aligned with a hole 54 of stationary member 44, air is supplied to radial passages 56. When the rotating member 45 and the slotted ring 65 rotate in the ω direction into a circumferential position, as shown in FIG. 9C of the drawings, holes 54 are blocked. The pulsing reduces the net amount of compressed air that is required. This also reduces the amount of input energy needed by the air compressor 22 and the prime mover 21 and, thus, saves on initial capital equipment and operating costs. Experimentation has shown that a supersonic air jet pulsed at a frequency of approximately two to three times per second, can excavate in a very energy effective manner. By pulsing the jets, the amount of dust created also is greatly reduced, which for sensitive environmental remediation applications is a significant advantage. Those skilled in the art will recognize that any number of combinations of holes 54, slots 66 and radial passages 56 located in one or more than one horizontal plane or circumferential location could pulse the nozzles.

Figure 10:
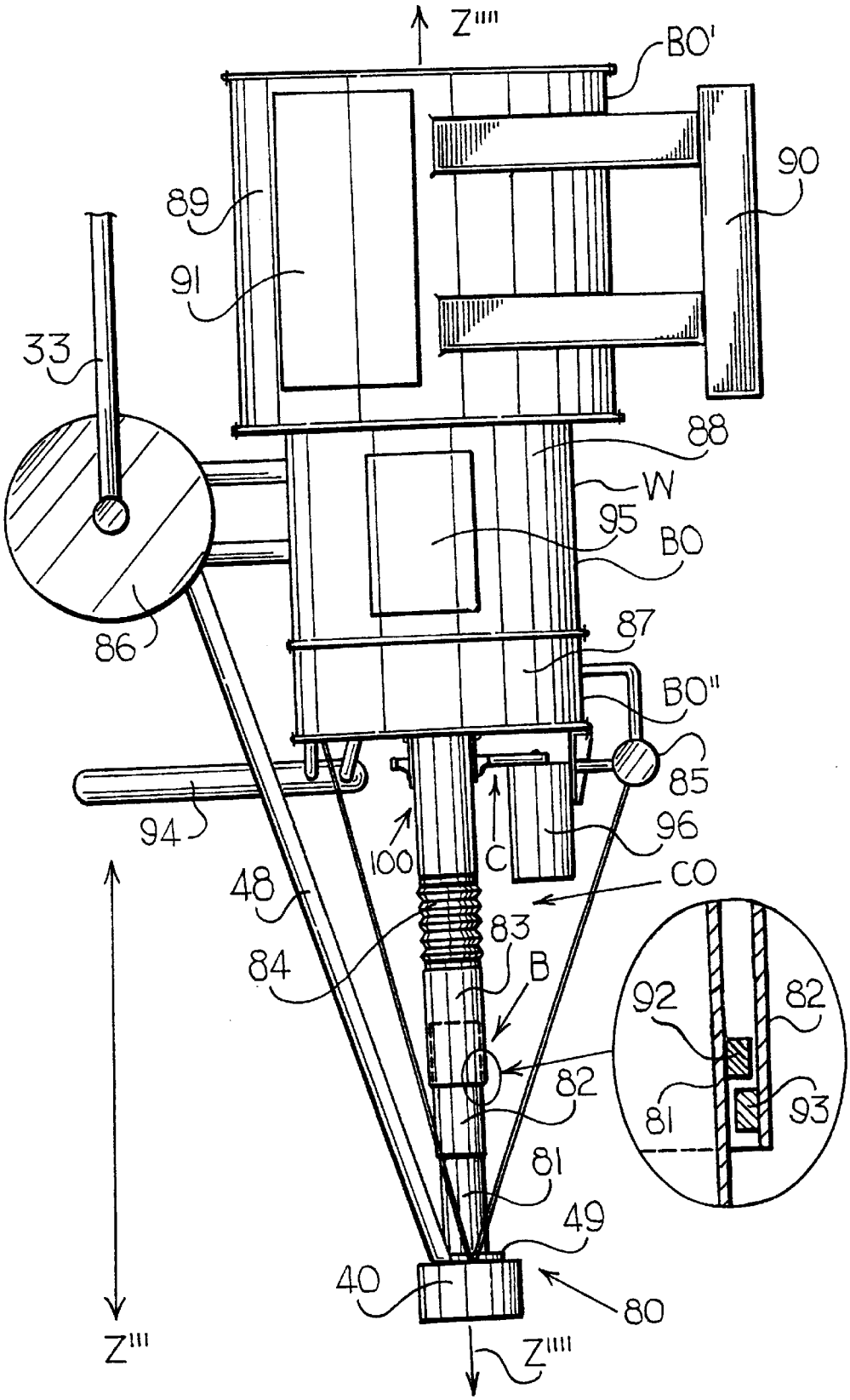
FIG. 10 is a plan view of the material separator including boom sections, rotary valves, primary and secondary separator sections and support structures made in accordance with the present invention.

As shown in FIG. 10 of the drawings, the material separator assembly or separator 80 contains an arrangement to receive the excavated material from the excavation head 40, to isolate the excavated material from the airstream, to separately discharge the material, and to clean and separately discharge the air. The material separator assembly 80, which is compactly arranged, includes material transport boom sections 81, 82 and 83, a primary separator 88, a secondary separator 89, a rotary valve 87 and a support 90 by which the material separator assembly 80 is attached to the equipment package 20. The material separator assembly 80 components are preferably constructed, for the most part, of carbon steel and are designed to withstand the vacuum suction created by the vacuum pump 25. The boom sections 81, 82 and 83 are slidably received to each other to form a telescopic boom or conduit B which can vary in length. For chemical or radioactive remediation, a stainless steel material could be substituted for the carbon steel for decontamination purposes.

Support 90 serves as the mounting of material separator assembly 80 to the equipment package 20 and can take many forms. In the simplest arrangement, as shown in FIG. 10, support 90 includes multiple metal channels or beams of steel or aluminum, for example, rigidly fixed to the material separator assembly 80 and the equipment package 20. In this instance, the horizontal motion of the excavation head 40 is provided by movement of the equipment package 20 itself on the mobile base 28 and relative to a target or site to have material removed. In another arrangement, the support 90 can include slides or another arrangement to move the material separator assembly 80 in a Cartesian coordinate or rectilinear fashion in two or three dimensions, whereby the separator moves horizontally and/or vertically in relation to the equipment package 20. These arrangements are known in the state of the art, for example, such as in forklift trucks and, therefore, need not be detailed herein. Alternatively, the relative motion could be accomplished in a cylindrical coordinate or curvilinear, i.e., rotational, fashion by pivoting the material separator assembly 80 about a fixed axis or axes as is done commonly with backhoes or hydraulic excavators (see FIGS. 13A and 13B). In these arrangements, the excavation head(s) 40 can be moved relative to the mobile base 28.

As mentioned before, in operation the excavation head 40 is moved in a horizontal plane P, containing X and Y axes, by motions of the mobile platform 10 or by motions of the support 90 attaching the material separator assembly 80 to the equipment package 20, the excavation head 40 is moved in a vertical direction or along axis Z''' by extension or retraction of the telescoping material transport boom B or by the support structure. In the present embodiment, the telescoping boom B includes three tubular section members 81, 82 and 83. Lower tubular section 81 connects to and is fluidly coupled to the lower vacuum tube 49 from the excavation head 40 and receives material directly from the excavation head 40 and is nominally of the same diameter. Tubular section 81 has a slightly smaller diameter than tubular section 82 which in turn has a smaller diameter than tubular section 83. Round tubes are preferred, although other shapes such as rectangular or hexagonal tubes could be used. Excavation begins with the lower tubular section 81 substantially withdrawn inside each of the upper tubular sections 82 and 83. As the excavation gets deeper, the lower tubular section 81 extends from the tubular sections 82, increasing the penetration of the excavation head 40 into the ground. At some point, the lower tubular section 81 is fully extended and the middle tubular section 82 begins to be withdrawn. The tubular sections 81, 82 and 83 are preferably made of a non-metallic material, such as a glass fiber reinforced epoxy composite for its light weight and electrical insulation properties. Less or more than three sections of tubing may be employed for the telescoping boom B, depending on the digging depth below grade that must be achieved. Short, thin rings 92 are installed respectively on outer surfaces of tubular sections 81 and 82 near their respective upper end and short, thin rings 92 are installed on inner surfaces of tubular sections 82 and 83 near their respective lower ends. Rings 92 and 93 serve several functions including as bearings upon which the tubes slide, as stops for tube extension and as vacuum seals. They may be made from a number of high wear, low friction materials, such as Teflon® or nylon. Rings 92 and 93, which are only shown for a portion of tubular sections 81 and 82, are adapted to coact with each other so that they abut each other when the tubular sections are in an extended position so as to act as a stop.

At an upper end of the tubular section 83, a semi-flexible joint 84 is secured. Although it generally maintains a vertical alignment of the boom B and excavation head 40, the flexible joint 84 provides some compliance in the system so that the boom can flex out of the way in the event that an object is encountered in the excavation as the boom B and excavation head 40 are moved horizontally. The flexible joint 84 may be of several different constructions, such as a rubber or metal bellows with a suitable number of multiple convolutions to give the desired deflection characteristics.

Compressed air is fed from the equipment package 20 via the air pump hose 33 to a hose reel 86 mounted on the material separator assembly 80. Air hose 48 winds and unwinds from the reel as the boom sections 81, 82 and 83 are extended and retracted. In this manner, the air compressor 22 is fluidly coupled to the nozzle 60 via hoses 33 and 48. The vertical motion of the boom may be by a number of methods including, as shown, a winch 85 secured to a hydraulic cylinder secured to the rotary valve 87, or alternatively an air cylinder, rack and pinion gearing, a ball screw or the like.

Figure 11:
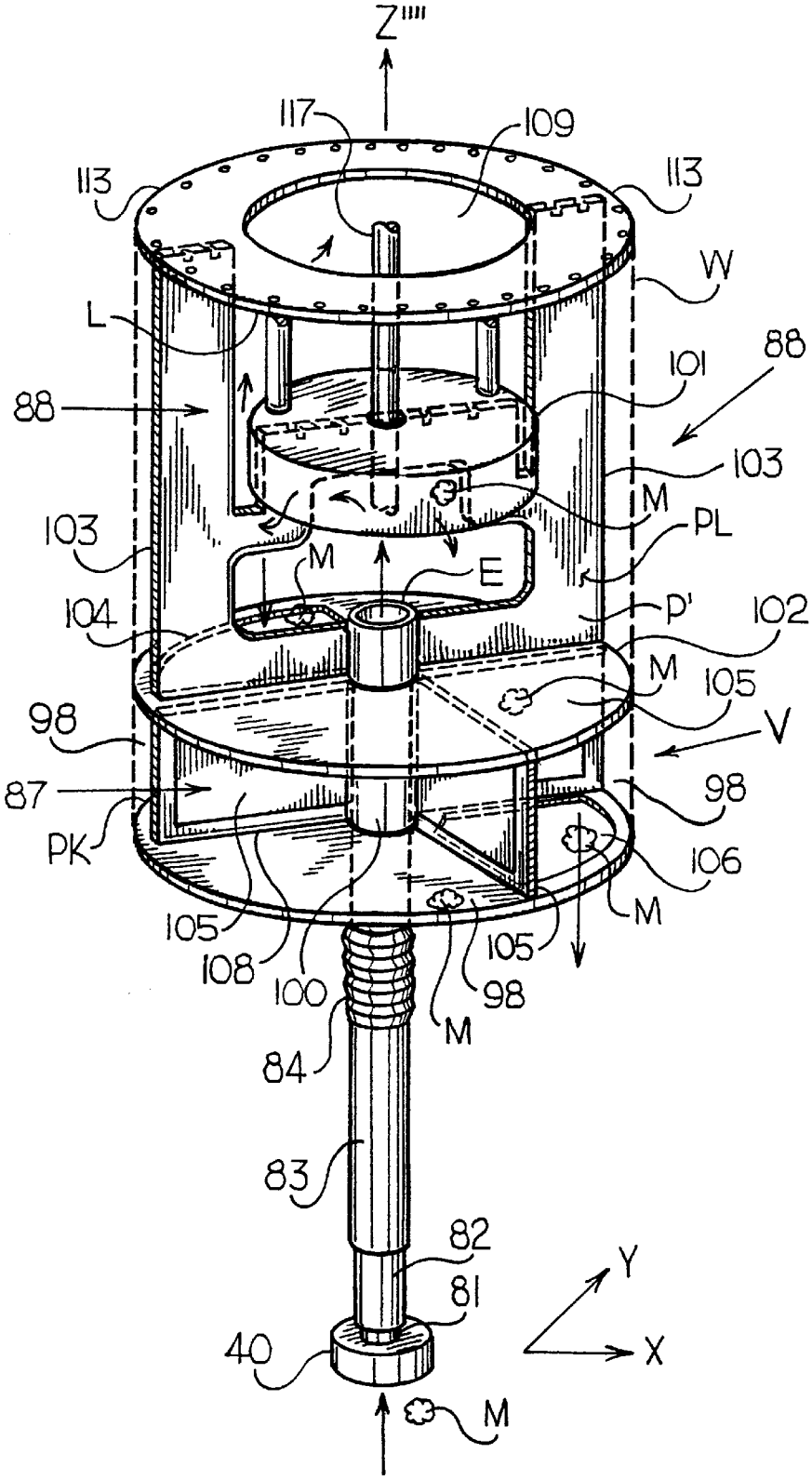
FIG. 11 is a perspective view of a portion of the separator.

The separation of the material from the airstream is best explained by referring to FIG. 11 of the drawings, which shows the internal structure of a rotary valve 87 and a primary separator 88. The primary separator 88 includes an outer cylindrical shell or body BO that defines a plenum chamber PL. Material M which travels up through the upper boom section 83 and flexible joint 84 first encounters shaft 100 which is of substantially the same diameter. Shaft 100 is hollow and allows the material M to pass upward through it and into the primary separator 88. In the primary separator 88, by a combination of air velocity magnitude and direction changes and deflection plates, the vast majority of the excavated material drops out of the airstream due to gravity. Structure or deflector plate 101 is an inverted, shallow cup constructed preferably out of a wear resistant steel such as AR plate. Structure 101 is spaced from an exit end E of shaft 100. Boom B is fluidly coupled to the central opening 67, the shaft 100 which, in addition to lower vacuum tube 49, forms a conduit CO that is fluidly coupled to the material separator assembly 80. Preferably, conduit CO is arranged so that it extends along axis Z"" so that material M sucked into the primary separator 88 travels in a substantially straight path before contacting the structure 101. However, as stated previously, the flexible joint 84, which forms part of the conduit CO, does permit some bending to the conduit CO. The majority of material M impacts a lower surface of the structure 101 so that the material M is deflected and falls to a bottom of the primary separator 88 to rest on a plate 102. Preferably, the average upward air velocity in the large diameter of the primary separator is, by design, well below the value that is needed to pneumatically transport the material up through the tubular sections 81, 82 and 83, the flexible joint 84 and tubular shaft 100. The construction of structure 101 as a shallow inverted cup also redirects the main air flow from shaft 100 downward carrying material particles M along with it. A plurality of vanes or moving members 103 rotate about the vertical central axis Z"" of the separator and serve several functions and are secured to the tubular shaft 100. A bottom portion P' of the vanes 103 continuously sweeps or directs material M that accumulates on plate 102 into a quadrant opening or exit port 104 defined in the plate 102 which the dislodged material can pass. Upper and side portions of the vanes 103 continuously clean interior walls W (shown in phantom) of the primary separator 88 and lower surface L of structure 101 to prevent the accumulation or buildup of damp or sticky material. Vanes 103 are positioned adjacent interior walls W and lower surfaces L of structure 101 to dislodge material therefrom. Access into the primary separator 88 is provided by a door 95, as shown in FIG. 10 of the drawings.

Multiple rotor vanes 105 are attached to hollow tubular shaft 100. These form, in the preferred embodiment, four sealed pockets 98 which continuously rotate in rotary valve 87 which is fluidly coupled to the primary separator 88. Rotary valve 87 includes a body or outer shell BO". As a pocket PK rotates below quadrant opening 104, material M (shown in phantom) from the primary separator 88 falls into the respective pocket. The dimensions of the pocket PK are larger than the diameter of the lowest transport tubular section 81 so that any soil or rock taken in by the system will fit in the pocket PK. This pocket PK subsequently rotates about the axis Z"" until it is positioned above an opening or exit opening 106 defined in a fixed plate 107 which is open to atmosphere and discharges its material M (shown in phantom). Fixed plate 107 is secured to wall W. Material M exiting the rotary valve 87 via opening 106 falls via a chute onto a short conveyor 94 or any other type of arrangement to move the exiting material M away from the material separator assembly 80, as shown in FIG. 10 of the drawings, which in turn deposits the material M into waiting containers or onto the ground. Opening 106 is positioned on plate 107 so that it is diametrically opposed to quadrant opening 104 positioned on plate 102. Quadrant opening 104 is in fluid communication with the rotary valve 87. By this construction, a vacuum lock V is always maintained by at least two rotating rotor vanes 105 being interposed between these openings 104 and 106 so that the air pressure in the primary separator 88 as well as tubular sections 81, 82 and 83 and shaft 100 are below atmospheric pressure when a vacuum source is coupled thereto. Rotary vanes 105 are contained within the rotary valve body BO". The vertical orientation of the shaft 100 also lessens the possibility of material buildup at a base where the vanes 105 attach to the shaft 100 than if shaft 100 had a horizontal or inclined orientation. As shown in FIG. 11, all of the rubbing edges of the vanes 105 may be lined with a fabric reinforced rubber type material 108. This lessens the chance that a small rock could wedge between the steel edges and cause a jam. An electric or a hydraulic motor 96, as shown in FIG. 10 of the drawings, is secured to an outer surface of the rotary valve 87 and rotates the shaft 100, and thus vanes 103 and 105 through either a chain and sprocket assembly C in the preferred embodiment or via a belt and pulleys or via gears. Bearings are provided to align the shaft 100 with the plate 107. Vanes 103 and 105 are rigidly secured to the shaft 100 so that lower edges of the vanes 103 and 105 rest on upper surfaces of the plates 102 and 107, respectively. The shaft 100 maintains a vertical orientation by thrust bearings and radial bearings.

Figure 12B:
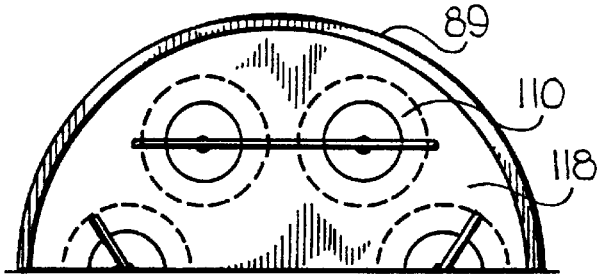
FIG. 12B is a section taken along lines XIIB—XIIB of FIG. 12A.
Figure 12C:
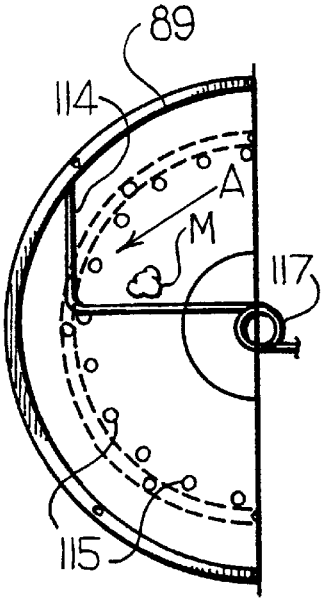
FIG. 12C is a section taken along lines XIIC—XIIC of FIG. 12A.
Figure 12A:
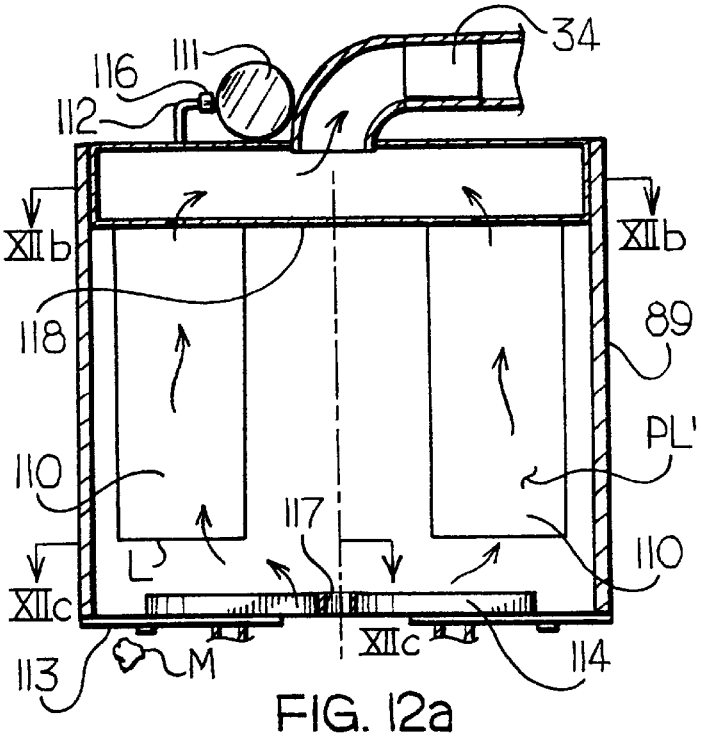
FIG. 12A is a partial cross-sectional view of an upper section of the separator.

Air drawn by the vacuum pump 25 now carrying only the very fine particulate matter from the excavated material circulates up around structure 101 and exits into secondary separator 89 through a large central opening 109. Secondary separator 89, which is fluidly coupled to the primary separator 88, also includes an outer shell of body BO'. As shown in FIGS. 12A, 12B and 12C of the drawings, preferably six multiple cartridge type filters 110 (of which only two are shown) are positioned within a secondary plenum chamber PL' for removing the remaining fines of the material M from the airstream by cloth and cake filtration and are provided within body BO' and fluidly coupled to the vacuum pump or vacuum source 25. The number of cartridge type filters can vary. The cartridge type filters 110 which are well known in the art are supported from a tube sheet 118. The cartridge type filters 110, one or two at a time, are cleaned during operation by pulses of compressed cleaning air which periodically flow air through them in a reverse flow so as to force the fines onto the plate 113. An access door 91, as shown in FIG. 10 of the drawings, is provided for cartridge type filter replacement. The cleaning air, which is supplied from manifold 111 fed by the air compressor 22, is released on a periodic time or pressure drop basis by valves 116 through blow pipes 112. Clean air exits from the top of the material separator assembly 80 and travels via a combination of rigid pipe secured to flexible hose 34 to the inlet of the vacuum pump 25 on the equipment package 20. Loosened fine material particles M fall from the filters 110 when reverse flow cleaning air passes therethrough to a top of the plate 113. The fine particles are then swept by a plurality, in this case two, of rotating bent wipers 114 over a plurality of perforations or multiple openings 115 defined in the top plate 113 where the fine particles of the dislodged material M which cannot pass through the filters 110 to fall back into a low velocity region of the primary separator 88 by passing through the openings 115. In this arrangement, the openings 115 are in fluid communication with the primary separator 88. The angle A of the bend of the wiper 114 of approximately 90° has been chosen because through experimentation it has been found that the fine material M tends to move toward or be directed toward the bent location as the wiper 114 rotates. Other angles can also be used. Wipers 114 are attached to and driven by pin 117 which is attached to multiple vanes 103 as shown in FIG. 11 of the drawings. The multiple openings 115 are located on the plate so that the bend of each wiper 114 passes thereover so as to direct the fines toward the openings 115. Various numbers of filters 110, wipers 114 and multiple openings 115 may be used, depending upon the exact design requirements of the system.

As should now be evident, the present invention results in efficient excavation of material by directing a supersonic airstream toward a target material; dislodging the target material; sucking the dislodged material and air through a vacuum source into a plenum chamber; contacting the dislodged material with a deflector to cause the dislodged material to remain in a plenum chamber while permitting the sucked air to pass through the plenum chamber; and directing the dislodged material remaining in the plenum chamber to an exit port.

Figure 13A:
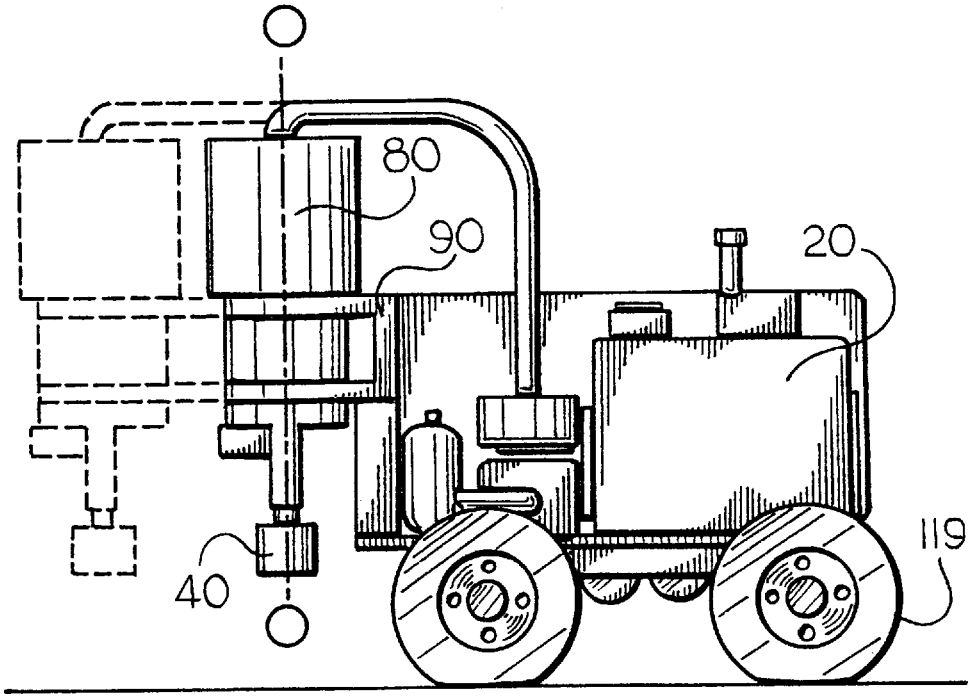
FIG. 13A is an elevational view of an alternative embodiment of the excavation system including a wheeled, mobile platform.
Figure 13B:
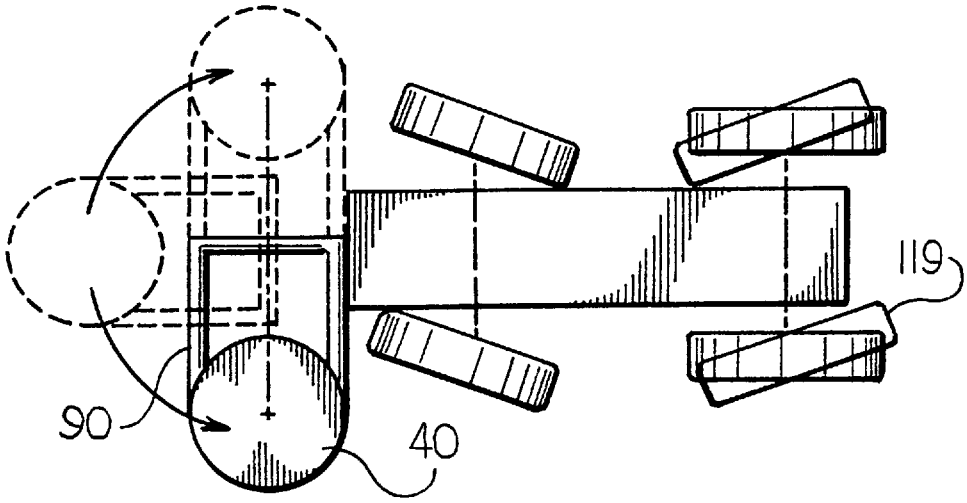
FIG. 13B is a bottom plan view of the alternative embodiment shown in FIG. 13A.

FIGS. 13A and 13B of the drawings show an alternative embodiment of the present invention where the excavating head 40, the material separator assembly 80 and the equipment package 20 are mounted on a wheeled base 119 rather than a tracked base. It also shows an alternative version of the separator support 90, wherein the separator motion is adapted to rotate about a vertical axis 00. In this manner, the separator assembly 80 can dig in-line on either side of the equipment package 20.

Figure 14:
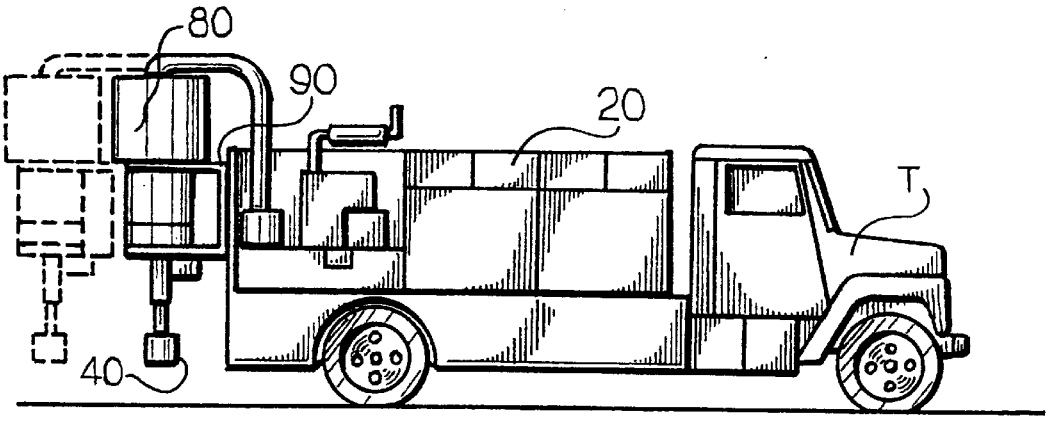
FIG. 14 is an elevational view of a further embodiment of the excavation system including a truck mounted unit.

FIG. 14 of the drawings shows an alternative embodiment of the present invention where the excavating head 40, separator assembly 80 and the equipment package 20 are mounted on the back of a standard truck T rather than on a tracked base. This figure also has a support 90 which can move the separator package horizontally in a Cartesian fashion relative to the equipment package 20.

Figure 15:
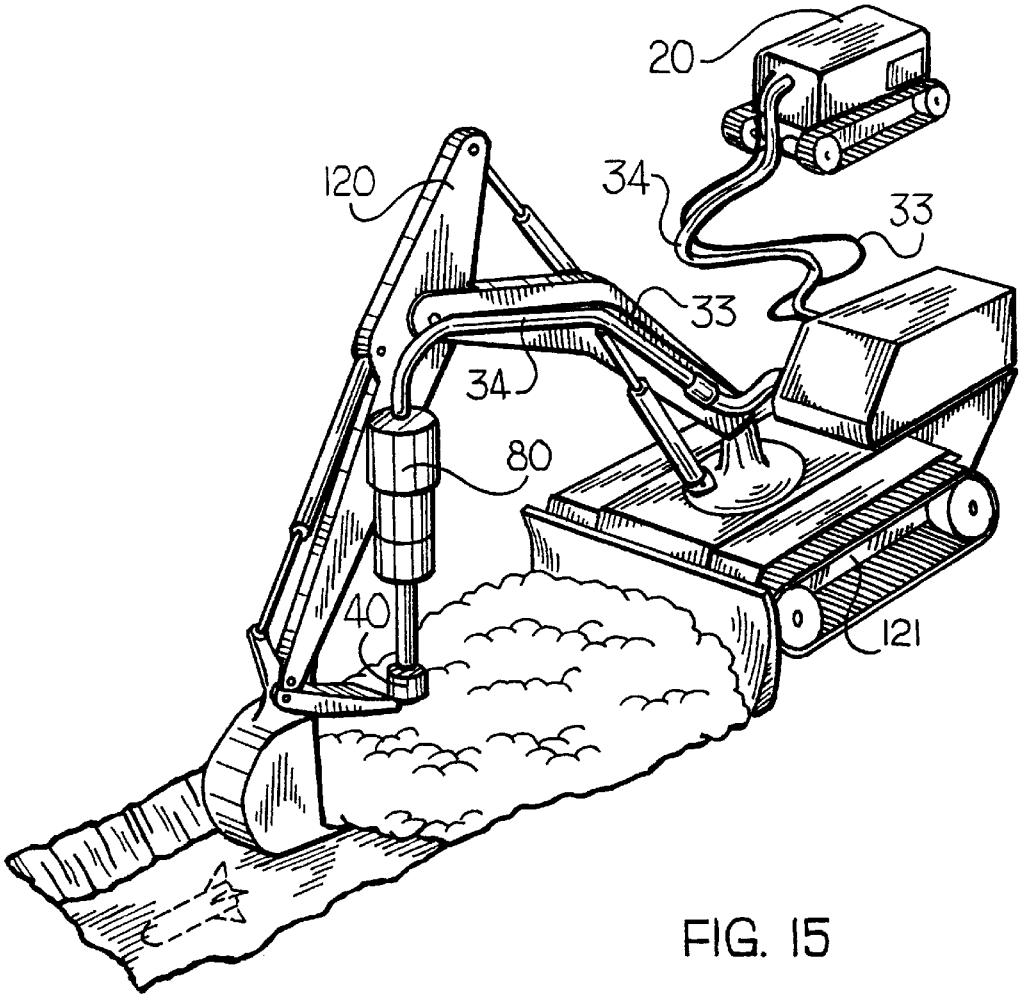
FIG. 15 is a perspective top view of a further embodiment of the present invention where a separator and an excavating head are placed independently from an equipment package.

FIG. 15 of the drawings shows a further embodiment of the present invention where the material separator assembly 80 is mounted independently from the equipment package 20. In this version, the excavating head 40 and material separator assembly are mounted onto a boom 120 of a standard hydraulic excavator 121. Extended lengths of flexible air pump hose 33 and a flexible hose 34 connect between the material separator assembly 80 and the equipment package 20.

Figure 16:
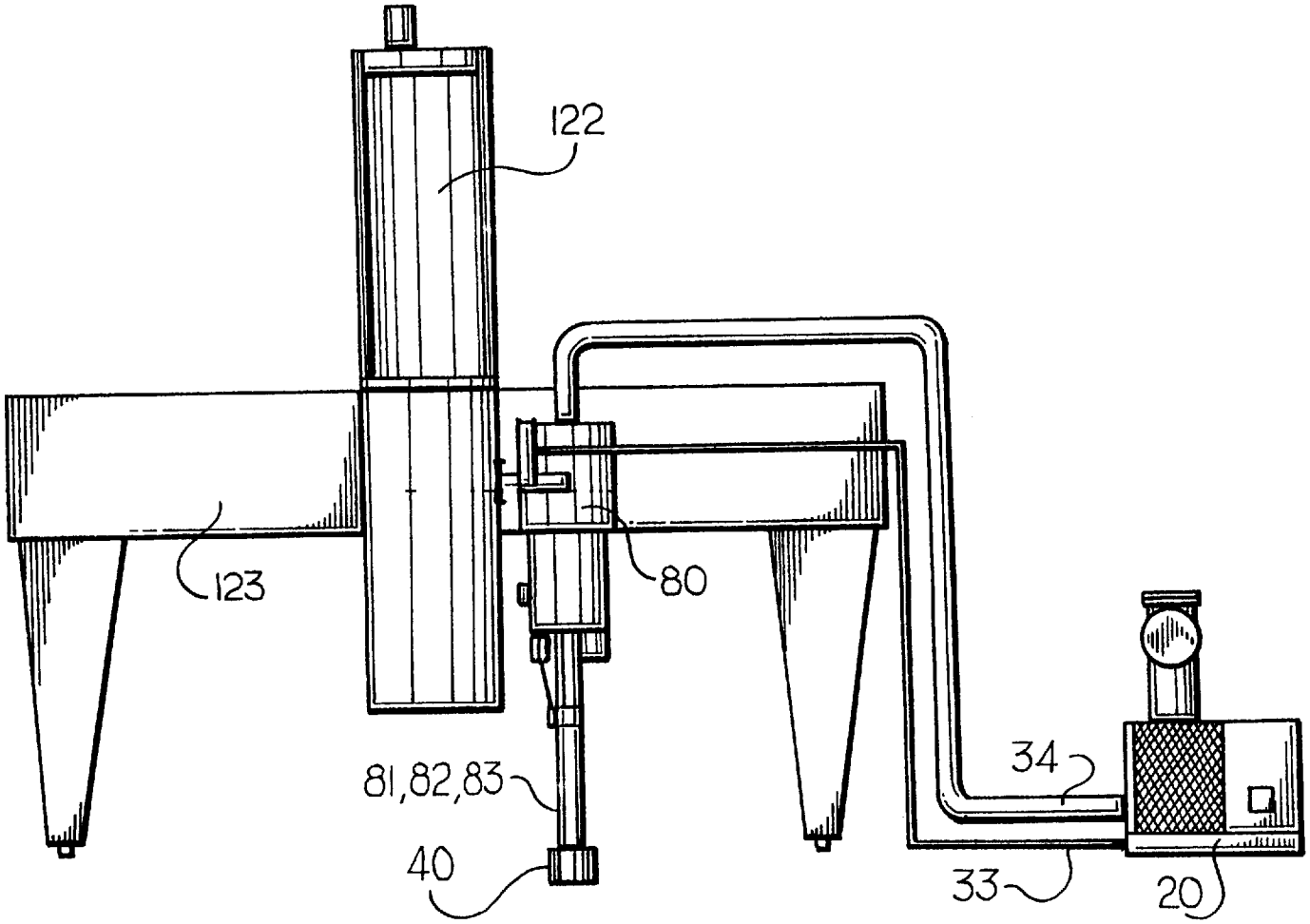
FIG. 16 is an elevational view of a further embodiment of the present invention where the separator and excavating head are placed independently from an equipment package.

FIG. 16 of the drawings shows another embodiment of the present invention where the material separator assembly 80 and the excavation head 40 are mounted independently from the equipment package 20. In this instance, the material separator assembly 80 and excavation head 40 are mounted on a trolley 122 of a standard rail type crane 123. The trolley 122 and the crane 123 permit, for example, east/west and north/south horizontal motions; while the extension/retraction of the tubular sections 81, 82 and 83 permit the vertical motion. The equipment package 20 here is on a stationary base. Again, hoses 33 and 34 connect between the material separator assembly 80 and the equipment package 20. The prime mover 21 is an electric motor in this case.

The reader thus can see that the apparatus described herein provides a novel safe excavation system with numerous advantages over the prior art. In particular:

It uses contoured nozzles to accelerate compressed air into highly focused streams at supersonic speeds which efficiently penetrate and dislodge most types of soil, but are harmless to buried objects requiring careful excavation such as cables, pipes, waste bottles or drums, or unexploded ordnance.

It synergistically integrates the vacuum suction and the air jets into a single, rotating excavating head which enables one man to operate the entire system.

The combined rotational and translational movement of the head causes each supersonic air jet to trace out a curtate trochoid on the working surface of the excavation. The patterns of jets are chosen to overlap to create an efficient soil digging means.

It combines the functions of material and air separation in a unique and compact configuration.

Since soil is generally not a free flowing material, especially when damp, it utilizes a material transport boom that minimizes clogging.

It utilizes a flowthrough material system of essentially unlimited capacity and work time without interruption to empty a conventional vacuum hopper.

It is easily adapted to complete remote operation which removes the operator from the vicinity of chemical or radioactive contamination.

It has the ability to work off-road in rough terrain where many waste sites are located.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

We claim:

1. An excavator, comprising:

an excavator head having an inlet port and an outlet port;

a conduit fluidly coupled to said inlet port; and a separator fluidly coupled to said conduit, wherein said outlet port is adapted to exit high speed air toward a target to dislodge material therefrom, said inlet port adapted to suck the dislodged material via a vacuum source, said separator comprising a rotating vane and a body defining a plenum chamber having a deflector plate spaced from an exit end of said conduit and adapted to deflect the sucked dislodged material, said separator defining an exit port through which the dislodged material can pass, wherein said exit port is separate from said inlet port, said rotating vane contained within said plenum chamber and adapted to direct the dislodged material to said exit port.

2. An excavator as claimed in claim 1, wherein said separator body includes a primary separator and a secondary separator, wherein said primary separator includes said deflector plate, said secondary separator fluidly coupled to said primary separator and comprises an air filter adapted to be fluidly coupled to a vacuum source.

3. An excavator as claimed in claim 2, wherein said secondary chamber comprises a body defining a secondary plenum chamber, wherein said air filters are contained within said secondary plenum chamber, said secondary chamber body including a plate defining a plurality of perforations whereby said perforations are in fluid communication with the primary plenum chamber and are adapted to permit any dislodged material prevented to pass through said air filter to pass through said perforations into the primary separator.

4. An excavator as claimed in claim 1, wherein said rotating vane is positioned adjacent said deflector plate and is adapted to dislodge the material from the deflector plate.

5. An excavator as claimed in claim 1, further comprising a rotary valve fluidly coupled to said separator, said rotary valve comprising a plurality of rotating vanes contained within a rotary valve body, and said separator exit port is in fluid communication with said rotary valve, said rotary valve body defining an exit opening which is separated from said exit port by at least two of said rotary valve vanes so as to maintain the plenum chamber at a pressure below atmospheric pressure when a vacuum source is fluidly coupled to said separator.

6. An excavator as claimed in claim 1, wherein said head, comprises:

a stationary member and a rotating member rotatably coupled to said stationary member, wherein said outlet port is positioned in said rotating member and comprises a nozzle for directing a stream of compressed air toward the target.

7. An excavator as claimed in claim 6, wherein said stationary member includes a compressed air inlet fluidly coupled to an annular region which is fluidly coupled to a passageway defined in said rotating member, said passageway fluidly coupled to said nozzle, and said conduit is fluidly coupled to said inlet port and passes through said rotating member.

8. An excavator as claimed in claim 7, wherein said conduit passes through said stationary member and said rotating member and said annular region is coaxial with said conduit and is defined by said conduit and said stationary member, and said nozzle is radially spaced away from said inlet.

9. An excavator as claimed in claim 7, further comprising a flow blocking member contained within said annular region and secured to said rotating member, whereby said flow blocking member periodically blocks said annular region and said passageway to periodically prevent the flow of compressed air to said nozzle thereby resulting in pulsing of air passing through said nozzle.

10. An excavator as claimed in claim 6, wherein said nozzle is a supersonic nozzle.

11. An excavator as claimed in claim 6, wherein said outlet port comprises a plurality of nozzles spaced circumferentially about said inlet port in said rotating member.

12. An excavator as claimed in claim 11, wherein said rotating member rotates about an axis and said nozzles are spaced at differing radii from the axis.

13. An excavator as claimed in claim 6, wherein said rotating member rotates about an axis and said nozzle is angled relative to the axis.

14. An excavator as claimed in claim 6, wherein said head body further comprises a skirt that axially extends beyond said nozzle and said inlet port.

15. An excavator as claimed in claim 6, further comprising means for rotating said rotating member relative to said stationary member.

16. An excavator as claimed in claim 1, wherein said conduit comprises a plurality of tubular members that are slidably secured to each other thereby forming a telescoping conduit.

17. An excavator as claimed in claim 1, further comprising an excavator support body for supporting said excavator head and said separator, said excavator support body having means for moving said excavator head relative to a target.

18. An excavator as claimed in claim 17, wherein said means for moving said excavator head relative to a target moves said excavator head in two dimensions.

19. An excavator as claimed in claim 18, wherein the movement of the excavator is in one of a rectilinear fashion and a curvilinear fashion.

20. An excavator as claimed in claim 17, wherein said means for moving said head relative to a target causes said outlet port to move in a curtate trochoid path.

21. An excavator as claimed in claim 1, further comprising a mobile base secured to said separator.

22. An excavator as claimed in claim 21, wherein said mobile base comprises an air compressor fluidly coupled to said outlet port and a vacuum pump fluidly coupled to said separator.

23. An excavator as claimed in claims 22, further comprising means for moving said excavator head relative to said mobile base.

24. An excavator as claimed in claim 1, wherein a longitudinal axis passes through said excavator head, said conduit and said separator so that the material sucked into said separator travels a substantially straight path before contacting said deflector plate.

25. An excavator as claimed in claim 1, further comprising means for moving exited dislodged material away from the excavator.

26. An excavator, comprising:

an excavator head having an inlet port and an outlet port;

a conduit fluidly coupled to said inlet port; and a separator fluidly coupled to said conduit, wherein said outlet port is adapted to exit high speed air toward a target to dislodge material therefrom, said inlet port adapted to suck the dislodged material via a vacuum source, said separator comprising a rotating vane and a body defining a plenum chamber having a deflector plate spaced from an exit end of said conduit and adapted to deflect the sucked dislodged material, said separator defining an exit port through which the dislodged material can pass, wherein said exit port is separate from said inlet port, said rotating vane positioned adjacent said deflector plate and adapted to dislodge the material from the deflector plate.

27. An excavator as claimed in claim 26, wherein said deflector plate is cup-shaped and said separator further comprising a rotating member contained within said plenum chamber and adapted to direct the dislodged material to said exit port.

28. An excavator as claimed in claim 27, further comprising a rotary valve fluidly coupled to said separator, said rotary valve comprising a plurality of rotating vanes contained within a rotary valve body, and said separator exit port is in fluid communication with said rotary valve, said rotary valve body defining an exit opening which is separated from the exit port by at least two of said rotary valve vanes so as to maintain the plenum chamber at a pressure below atmospheric pressure when a vacuum source is fluidly coupled to said separator, wherein said conduit passes through said rotary valve.

29. An excavator as claimed in claim 28, wherein said secondary chamber comprises a body defining a secondary plenum chamber and a rotating wiper, wherein said air filters are contained within said secondary plenum chamber, said secondary chamber body including a plate defining a plurality of perforations, whereby said perforations are in fluid communication with the primary plenum chamber and are adapted to permit dislodged material to pass through said perforations into the primary separator which is prevented from passing through said air filter, and said rotating wiper contained within said secondary chamber adapted to direct dislodged material towards the perforations.

30. An excavator as claimed in claim 29, further comprising means for rotating said vanes.

31. An excavator, comprising:

an excavator head having an inlet port and an outlet port;

a conduit fluidly coupled to said inlet port; and a separator fluidly coupled to said conduit, wherein said outlet port is adapted to exit high speed air toward a target to dislodge material therefrom, said inlet port adapted to suck the dislodged material via a vacuum source, said separator comprising a body defining a primary plenum chamber having a deflector plate spaced from an exit end of said conduit and adapted to deflect the sucked dislodged material, said separator defining an exit port through which the dislodged material can pass, wherein said exit port is separate from said inlet port, said separator includes a primary separator and a secondary separator, wherein said primary separator includes said deflector plate and said secondary separator is fluidly coupled to said primary separator, said secondary separator comprises an air filter adapted to be fluidly coupled to a vacuum source and a body defining a secondary plenum chamber, wherein said air filters are contained within said secondary plenum chamber, said secondary plenum chamber body including a plate defining a plurality of perforations whereby said perforations are in fluid communication with said primary plenum chamber and are adapted to permit any dislodged material prevented to pass through said air filter to pass through said perforations into said primary separator.

32. An excavator as claimed in claim 31, further comprising a rotating wiper contained within said secondary chamber which is adapted to direct dislodged material towards the perforations.

33. An excavator, comprising:

an excavator head having an inlet port, an outlet port, a flowing blocking member, a stationary member and a rotating member rotatably coupled to said stationary member, wherein said outlet port is positioned in said rotating member and comprises a nozzle for directing a stream of compressed air toward a target, said stationary member includes a compressed air inlet fluidly coupled to an annular region which is fluidly coupled to a passageway defined in said rotating member, said passageway fluidly coupled to said nozzle, said flow blocking member contained within said annular region and secured to said rotating member, whereby said flow blocking member periodically blocks said annular region and said passageway to periodically prevent the flow of compressed air to said nozzle thereby resulting in pulsing of air passing through said nozzle;

a conduit fluidly coupled to said inlet port, wherein said conduit passes through said rotating member; and a separator fluidly coupled to said conduit, wherein said outlet port is adapted to exit high speed air toward the target to dislodge material therefrom, said inlet port adapted to suck the dislodged material via a vacuum source, said separator comprising a body defining a plenum chamber having a deflector plate spaced from an exit end of said conduit and adapted to deflect the sucked dislodged material, said separator defining an exit port through which the dislodged material can pass, wherein said exit port is separate from said inlet port.

34. An excavator as claimed in claim 33, wherein said flow blocking member is a slotted ring.

35. An excavator, comprising:

an excavator head having an inlet port and an outlet port;

a conduit fluidly coupled to said inlet port; and a separator fluidly coupled to said conduit, wherein said outlet port is adapted to exit high speed air toward a target to dislodge material therefrom, said inlet port adapted to suck the dislodged material via a vacuum source, said separator comprising a body defining a plenum chamber having a deflector plate spaced from an exit end of said conduit and adapted to deflect the sucked dislodged material, said separator defining an exit port through which the dislodged material can pass, wherein said exit port is separate from said inlet port and a longitudinal axis passes through said excavator head, said conduit and said separator so that the material sucked into said separator travels a substantially straight path before contacting said deflector plate.

36. An excavator as claimed in claim 35, wherein the longitudinal axis is a central axis.

37. A method for excavating material, comprising the steps of:

A. directing an airstream toward a target material;

B. dislodging the target material by the airstream;

C. sucking the dislodged material and air into a plenum chamber;

D. contacting the dislodged material with a deflector to cause the dislodged material to remain in a plenum chamber while permitting sucked air to pass through the plenum chamber; and E. directing the dislodged material remaining in the plenum chamber to an exit port via a rotating vane.

38. An excavator, comprising:

means for directing an airstream toward a target material for dislodging material by the airstream;

means for sucking the dislodged material and air into a plenum chamber;

means for contacting the dislodged material with a deflector to cause the dislodged material to remain in a plenum chamber while permitting the sucked air to pass through the plenum chamber; and means for directing the remaining material in the plenum chamber via a rotary vane into an exit port.

39. An excavator head, comprising:

a stationary member;

a rotating member rotatably coupled to said stationary member;

a nozzle for directing a stream of air toward a target, said nozzle secured to said rotating member;

a compressed air inlet defined in said stationary member;

a conduit passing through said stationary member and said rotating member and having a conduit inlet which is radially spaced from said nozzle, an annular region is defined by said conduit and said stationary member which is coaxial with said conduit, said compressed air inlet is fluidly coupled to said annular region which is fluidly coupled to said nozzle; and a flow blocking member contained within said annular region and secured to said rotating member whereby said flow blocking member is adapted to periodically block fluid communication between said annular region and said nozzle to periodically prevent a flow of compressed air to said nozzle thereby resulting in pulsing of air passing through said nozzle.

40. A separator for use with a suction conduit used in an excavator, comprising:

a body defining a plenum chamber, an inlet port adapted to be fluidly coupled to a suction conduit, an outlet port adapted to be fluidly coupled to a vacuum source, the suction conduit adapted to transport dislodged material to said plenum chamber, said body defining an exit port for dislodged material to pass;

a vane rotatably secured to said body and contained within said plenum chamber for directing the dislodged material toward the exit port; and a vacuum lock fluidly coupled to said exit port which is adapted to permit the dislodged material to pass.

41. An excavator, comprising:

an excavator head having an inlet port and an outlet port;

a conduit fluidly coupled to said inlet port;

a separator fluidly coupled to said conduit, wherein said outlet port is adapted to exit high speed air toward a target to dislodge material therefrom, said inlet port adapted to suck the dislodged material via a vacuum source, said separator comprising a body defining a plenum chamber having a deflector plate spaced from an exit end of said conduit and adapted to deflect the sucked dislodged material, said separator defining an exit port through which the dislodged material can pass, wherein said exit port is separate from said inlet port; and a rotary valve fluidly coupled to said separator, said rotary valve comprising a plurality of rotating vanes contained within a rotary valve body, and said separator exit port is in fluid communication with said rotary valve, said rotary valve body defining an exit opening which is separated from said exit port by at least two of said rotary valve vanes so as to maintain the plenum chamber at a pressure below atmospheric pressure when a vacuum source is fluidly coupled to said separator.

42. An excavator, comprising:

an excavator head having an inlet port, an outlet port, a stationary member and a rotating member rotatably coupled to said stationary member, wherein said outlet port is positioned in said rotating member and comprises a nozzle for directing a stream of air toward a target, said outlet port having a plurality of nozzles spaced circumferentially about said inlet port in said rotating member, wherein said rotating member is adapted to rotate about an axis and said nozzles are spaced at differing radii from the axis;

a conduit fluidly coupled to said inlet port; and a separator fluidly coupled to said conduit, wherein said outlet port is adapted to exit high speed air toward the target to dislodge material therefrom, said inlet port adapted to suck the dislodged material via a vacuum source, said separator comprising a body defining a plenum chamber having a deflector plate spaced from an exit end of said conduit and adapted to deflect the sucked dislodged material, said separator defining an exit port through which the dislodged material can pass, wherein said exit port is separate from said inlet port.

43. An excavator, comprising:

an excavator head having an inlet port, an outlet port, a skirt, a stationary member and a rotating member rotatably coupled to said stationary member, wherein said outlet port is positioned in said rotating member and comprises a nozzle for directing a stream of compressed air toward a target, said skirt axially extends beyond said nozzle port and said inlet port;

a conduit fluidly coupled to said inlet port; and a separator fluidly coupled to said conduit, wherein said outlet port is adapted to exit high speed air toward the target to dislodge material therefrom, said inlet port adapted to suck the dislodged material via a vacuum source, said separator comprising a body defining a plenum chamber having a deflector plate spaced from an exit end of said conduit and adapted to deflect the sucked dislodged material, said separator defining an exit port through which the dislodged material can pass, wherein said exit port is separate from said inlet port.

44. An excavator, comprising:

an excavator head having an inlet port and an outlet port;

a conduit fluidly coupled to said inlet port;

a separator fluidly coupled to said conduit, wherein said outlet port is adapted to exit high speed air toward a target to dislodge material therefrom, said inlet port adapted to suck the dislodged material via a vacuum source, said separator comprising a body defining a plenum chamber having a deflector plate spaced from an exit end of said conduit and adapted to deflect the sucked dislodged material, said separator defining an exit port through which the dislodged material can pass, wherein said exit port is separate from said inlet port; and an excavator support body for supporting said excavator head and said separator, said excavator support body having means for moving said excavator head relative to a target, wherein said means for moving said head relative to a target causes said outlet port to move in a curtate trochoid path.

45. A method for excavating material, comprising the steps of:

A. directing an airstream toward a target material;

B. dislodging the target material by the airstream;

C. sucking the dislodged material and air into a plenum chamber;

D. contacting the dislodged material with a deflector to cause the dislodged material to remain in a plenum chamber while permitting sucked air to pass through the plenum chamber; and E. directing the dislodged material remaining in the plenum chamber to an exit port via a moving member.

46. An excavator, comprising:

an excavator head having an inlet port and an outlet port;

a conduit fluidly coupled to said inlet port; and a separator fluidly coupled to said conduit, wherein said outlet port is adapted to exit high speed air toward a target to dislodge material therefrom, said inlet port adapted to suck the dislodged material via a vacuum source, said separator comprising a moving member and a body defining a plenum chamber having a deflector plate spaced from an exit end of said conduit and adapted to deflect the sucked dislodged material, said separator defining an exit port through which the dislodged material can pass, wherein said exit port is separate from said inlet port, said moving member contained within said plenum chamber and adapted to direct the dislodged material to the exit port.

* * * * *

UNITED STATES PATENT AND TRADEMARK OFFICE

CERTIFICATE OF CORRECTION

PATENT NO. : 5,860,232

DATED : January 19, 1999

INVENTOR(S) : Richard D. Nathenson et al.

It is certified that error appears in the above-identified patent and that said Letters Patent is hereby corrected as shown below:

Column 2 Line 53 "dryer" should read --drier--.

Column 2 Line 55 "dryer" should read --drier--.

Column 3 Line 18 "costs" should read --cost--.

Column 12 Line 31 "sections 82" should read --section 82--.

Column 13 Line 48 before "which" insert --through--.

Column 15 Line 5 after "filters 110" delete --to--.

Column 16 Line 3 after "prime mover" delete --21--.

Column 18 Line 23 Claim 23 "in claims 21" should read --in claim 21--.

Signed and Sealed this

Seventh Day of September, 1999

*Attest:*

Q. TODD DICKINSON

*Attesting Officer*

*Acting Commissioner of Patents and Trademarks*